US011898782B2

(12) United States Patent
Song et al.

(10) Patent No.: US 11,898,782 B2
(45) Date of Patent: Feb. 13, 2024

(54) MULTI-AIR CONDITIONER FOR HEATING AND COOLING OPERATIONS

(71) Applicant: LG ELECTRONICS INC., Seoul (KR)

(72) Inventors: Chiwoo Song, Seoul (KR); Yongcheol Sa, Seoul (KR); Jiyoung Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 45 days.

(21) Appl. No.: 17/474,346

(22) Filed: Sep. 14, 2021

(65) Prior Publication Data

US 2022/0090832 A1 Mar. 24, 2022

(30) Foreign Application Priority Data

Sep. 23, 2020 (KR) ..... 10-2020-0123156

(51) Int. Cl.
*F25B 41/40* (2021.01)
*F25B 41/24* (2021.01)
*F25B 49/02* (2006.01)

(52) U.S. Cl.
CPC ..... *F25B 41/40* (2021.01); *F25B 41/24* (2021.01); *F25B 49/02* (2013.01);
(Continued)

(58) Field of Classification Search
CPC . F24F 1/0003; F24F 1/06; F24F 11/36; F25B 2500/22; F25B 2500/221;
(Continued)

(56) References Cited

U.S. PATENT DOCUMENTS 5,186,017 A * 2/1993 Hancock ..... F25B 45/00 62/149
5,243,828 A * 9/1993 Paige ..... F25B 45/00 62/149

(Continued)

FOREIGN PATENT DOCUMENTS

CA 3065728 A1 * 3/2020 ..... F25B 45/00
CN 1821664 8/2006

(Continued)

OTHER PUBLICATIONS

JP-2001082816-A English Translation (Year: 2001).*

(Continued)

*Primary Examiner* — David J Teitelbaum
*Assistant Examiner* — Devon Moore
(74) *Attorney, Agent, or Firm* — KED & Associates LLP

(57) ABSTRACT

A multi-air conditioner for heating/cooling operation may include: at least one indoor unit which is installed in a room, and includes an indoor heat exchanger; an outdoor unit which is connected to the indoor unit through a refrigerant pipe, and includes an outdoor heat exchanger, a compressor, an outdoor expansion valve, and a four-way valve; at least one leakage blocking valve which is formed on the refrigerant pipe, and blocks a refrigerant flow in the refrigerant pipe when a refrigerant leak occurs from the refrigerant pipe in the room; and a buffer unit which is installed on the refrigerant pipe between the indoor unit and the outdoor unit, and collects refrigerant leaking from the refrigerant pipe. Accordingly, when the refrigerant leaks into the room, it is possible to minimize the amount of the leaking refrigerant by collecting the refrigerant in the buffer tank.

14 Claims, 15 Drawing Sheets

(52) U.S. Cl.
CPC ... *F25B 2345/002* (2013.01); *F25B 2500/222* (2013.01); *F25B 2600/2515* (2013.01)

(58) Field of Classification Search
CPC .... F25B 2500/222; F25B 41/40; F25B 41/24; F25B 49/02; F25B 2345/002; F25B 2600/2515
See application file for complete search history.

(56) References Cited

U.S. PATENT DOCUMENTS

| | | | | |
|---|---|---|---|---|
| 5,934,091 | A * | 8/1999 | Hanson | F25B 45/00 62/149 |
| 8,402,780 | B2 * | 3/2013 | Wiggs | F25B 31/004 62/503 |
| 11,131,471 | B1 * | 9/2021 | Butler | F24F 11/52 |
| 2011/0174002 | A1 * | 7/2011 | Jang | F25B 13/00 62/115 |
| 2014/0041401 | A1 | 2/2014 | Douglas | |

FOREIGN PATENT DOCUMENTS

| | | | | |
|---|---|---|---|---|
| CN | 104603557 | | 5/2015 | |
| CN | 106595105 | | 4/2017 | |
| CN | 108027179 | | 5/2018 | |
| JP | 05-118720 | | 5/1993 | |
| JP | 2001-082816 | | 3/2001 | |
| JP | 2001082816 | A * | 3/2001 | |
| JP | 2009-299910 | | 12/2009 | |
| JP | 2013-053756 | | 3/2013 | |
| JP | 2013053756 | A * | 3/2013 | |
| JP | 2015-094574 | | 5/2015 | |
| JP | 2016-191530 | | 11/2016 | |
| JP | 2020/143870 | | 9/2020 | |
| WO | WO-2007022779 | A1 * | 3/2007 | F25B 49/005 |
| WO | WO-2016071947 | A1 * | 5/2016 | F25B 1/00 |
| WO | WO 2017/010007 | | 1/2017 | |

OTHER PUBLICATIONS

JP-2013053756-A English Translation (Year: 2013).*
WO-2016071947-A1 English Translation (Year: 2016).*
German Office Action issued in Application No. 10 2021 210 534.3 dated Apr. 7, 2022.
Korean Office Action issued in Application No. 10-2020-0123156 dated Dec. 6, 2021.
Chinese Office Action issued in Application No. 202111108923.5 dated Nov. 29, 2022.

* cited by examiner

MULTI-AIR CONDITIONER FOR HEATING AND COOLING OPERATIONS

CROSS-REFERENCE TO RELATED APPLICATION

This application claims the priority benefit of Korean Patent Application No. 10-2020-0123156, filed on Sep. 23, 2020, the disclosure of which is incorporated herein by reference in its entirety.

BACKGROUND OF THE INVENTION

1. Field of the Invention

The present disclosure relates to a multi-air conditioner for heating/cooling operation, and more particularly, to a multi-air conditioner for heating/cooling operation capable of minimizing refrigerant leakage.

2. Description of the Related Art

In general, a multi-type air conditioner is an air conditioner that connects a plurality of indoor units to a single outdoor unit, and uses each of the plurality of indoor units as a cooler or a heater while using the outdoor unit in common.

Recently, a plurality of outdoor units are connected in parallel to each other and used to effectively respond to a cooling or heating load according to the number of operating indoor units.

A multi-air conditioner according to the related art includes a plurality of outdoor units, a plurality of indoor units, and a refrigerant pipe connecting the plurality of outdoor units and the plurality of indoor units. Here, the plurality of outdoor units include a main outdoor unit and a plurality of sub-outdoor units.

Each of the plurality of outdoor units includes a compressor that compresses a gaseous refrigerant of low temperature and low pressure to be a high temperature and high pressure refrigerant, an outdoor heat exchanger for heat-exchanging the circulated refrigerant with outdoor air, and a four-way valve that switches refrigerant flow according to cooling or heating operation. Each of the plurality of indoor units includes an expansion device, and an indoor heat exchanger that heat-exchanges the circulated refrigerant with indoor air.

In the multi-air conditioner according to the related art configured as described above, during the cooling operation, the refrigerant compressed by the compressor of the main outdoor unit and the sub outdoor unit is transferred to the outdoor heat exchanger by the four-way valve, the refrigerant passing through the outdoor heat exchanger is condensed by heat exchange with ambient air, and then transferred to the expansion device. The refrigerant expanded by the expansion device flows into the indoor heat exchanger and evaporates while absorbing heat from the indoor air, thereby cooling the room.

Meanwhile, during the heating operation, a flow path is switched in the four-way valve, and the refrigerant discharged from the compressor sequentially passes through the four-way valve, an indoor heat exchanger, an outdoor linear expansion valve (LEV), and an outdoor heat exchanger, thereby heating the room.

Meanwhile, the refrigerant regulation policy in accordance with a fluorine gas (F-gas) emission regulation and a mandatory reduction of greenhouse gas is changing, and strategic development of products is required to respond to this. Specifically, the 6th edition of the International Electrotechnical Commission (IEC) international standard limited the filling amount of refrigerant, but as it is revised to the 7th edition of the IEC international standard, the regulation is changed to limit the leakage amount of refrigerant.

Accordingly, the need for management of refrigerant leakage is further emerging.

In general, it is proposed that when refrigerant leaks as shown in FIG. 1A, a sensor detects the refrigerant leakage and stops a system to notify a consumer, and there is a method that when refrigerant leak is detected as shown in FIG. 1B, a refrigerant blocking valve is closed so that the refrigerant existing in an indoor pipe is minimally discharged.

U.S. Patent Publication US20140041401A1 discloses a technology that each indoor unit room is equipped with a leak sensor that detects refrigerant leakage, and changed to a refrigerant leak mode when the refrigerant leaks. In this mode, a sol valve is closed, the compressor is operated, the refrigerant is collected by suction of the compressor, and the low pressure is lowered to atmospheric pressure.

When the valve is blocked as in FIG. 1B and US Patent Publication, the amount of refrigerant leaking into the room may be relatively small, but if the length of an indoor pipe increases and refrigerant leakage occurs in a liquid pipe, the amount of leaked refrigerant also cannot be ignored.

In addition, when the refrigerant leaks as shown in FIGS. 2A and 2B, since the leaking position cannot be predicted, if a blocking valve is disposed indoors, the leakage position is disposed between the indoor unit and the blocking valve as shown in FIG. 2A, or when it occurs between the blocking valve and a room as shown in FIG. 2B, the leaked refrigerant remains in the room.

Such leaking refrigerant in the room may have a fatal effect on a user.

Therefore, if the leakage of the refrigerant cannot be avoided, it is necessary to configure a system so that the minimum amount of the refrigerant leaks and also the minimum damage to the user occurs.

SUMMARY OF THE INVENTION

A first object of the present disclosure is to provide an air conditioner system capable of minimizing the amount of leaking refrigerant when the refrigerant leaks.

A second object of the present disclosure is to provide an air conditioner system capable of minimally affecting a user by setting an optimized position of a blocking valve when a blocking valve is applied to block a refrigerant flow when a refrigerant leaks.

A third object of the present disclosure is to provide a multi-air conditioner for heating/cooling operation that reduces a total amount of leaked refrigerant by lowering the pressure of a liquid pipe to minimize the amount of leaked refrigerant during a time when a blocking valve is closed.

In order to control the amount of leaking refrigerant which is an object of the present disclosure, the present disclosure provides a multi-air conditioner for heating/cooling operation, the multi-air conditioner including: at least one indoor unit which is installed in a room, and comprises an indoor heat exchanger; an outdoor unit which is connected to the indoor unit through a refrigerant pipe, and comprises an outdoor heat exchanger, a compressor, an outdoor expansion valve, and a four-way valve; at least one leakage blocking valve which is formed on the refrigerant pipe, and blocks a refrigerant flow in the refrigerant pipe when a refrigerant leak occurs from the refrigerant pipe in the room; and a buffer unit which is installed on the refrigerant pipe between the indoor unit and the outdoor unit, and collects refrigerant leaking from the refrigerant pipe.

The at least one leakage blocking valve is installed outside the room in which the indoor unit is installed.

The buffer unit includes: a buffer tank which collects the refrigerant flowing in the refrigerant pipe; a low pressure buffer pipe which is connected to a bottom side of the buffer tank and sets a low pressure in the buffer tank; and a high-pressure buffer pipe which is connected to an upper side of the buffer tank and sets a high pressure in the buffer tank.

The refrigerant pipe includes: a liquid pipe connection pipe through which a high-pressure liquid refrigerant flows; and a gas pipe connection pipe through which a high-pressure gas refrigerant flows.

The high-pressure buffer pipe is connected to the liquid pipe connection pipe to flow the refrigerant of the liquid pipe connection pipe.

The refrigerant pipe further includes a common pipe through which a gas refrigerant of low pressure flows, wherein the low-pressure buffer pipe is connected to the common pipe to set a low pressure in the buffer tank.

The low-pressure buffer pipe is connected to an input terminal of the compressor to set a low pressure in the buffer tank.

The buffer unit comprises a buffer valve in each of the low-pressure buffer pipe and the high-pressure buffer pipe, and the buffer valve is opened to flow the refrigerant when the refrigerant leaks.

An opening/closing time of the refrigerant blocking valve is longer than an opening/closing time of the buffer valve.

When a refrigerant leak is detected in the room, the leak blocking valve is opened and, at the same time, the buffer valve is opened so that the refrigerant flowing in the refrigerant pipe is collected in the buffer tank.

The multi-air conditioner further includes a water level sensor on an inner wall of the buffer tank.

The water level sensor periodically detects a level of the collected refrigerant, and closes the buffer valve when a detected value is greater than or equal to a threshold value.

The multi-air conditioner further includes a leak detection sensor which detects a refrigerant leak from the refrigerant pipe in the room; and an indoor unit controller which transmits a leak detection signal to the outdoor unit when receiving the leak detection signal from the leak detection sensor.

The outdoor unit further includes a controller which controls the compressor, the four-way valve, the leakage blocking valve, and the buffer valve when receiving the leak detection signal from the indoor unit controller.

The multi-air conditioner further includes a distributor which is disposed between the outdoor unit and the at least one indoor unit, and distributes the refrigerant to the at least one indoor unit according to a cooling or heating operation mode.

The distributor includes a low-pressure valve which flows a low-pressure gas refrigerant to a gas pipe connected to the indoor unit; and a high-pressure valve which flows a high-pressure gas refrigerant to the gas pipe connected to the indoor unit.

The distributor further includes a liquid header; a low-pressure gas header; and a high-pressure gas header through which a refrigerant having a higher pressure than a refrigerant in the low-pressure gas header flows.

When the refrigerant leak is detected, one of the low-pressure valve and the high-pressure valve is completely opened.

BRIEF DESCRIPTION OF THE DRAWINGS

The above and other objects, features and advantages of the present disclosure will be more apparent from the following detailed description in conjunction with the accompanying drawings, in which.

DETAILED DESCRIPTION OF THE PREFERRED EMBODIMENTS

Figure 1A:
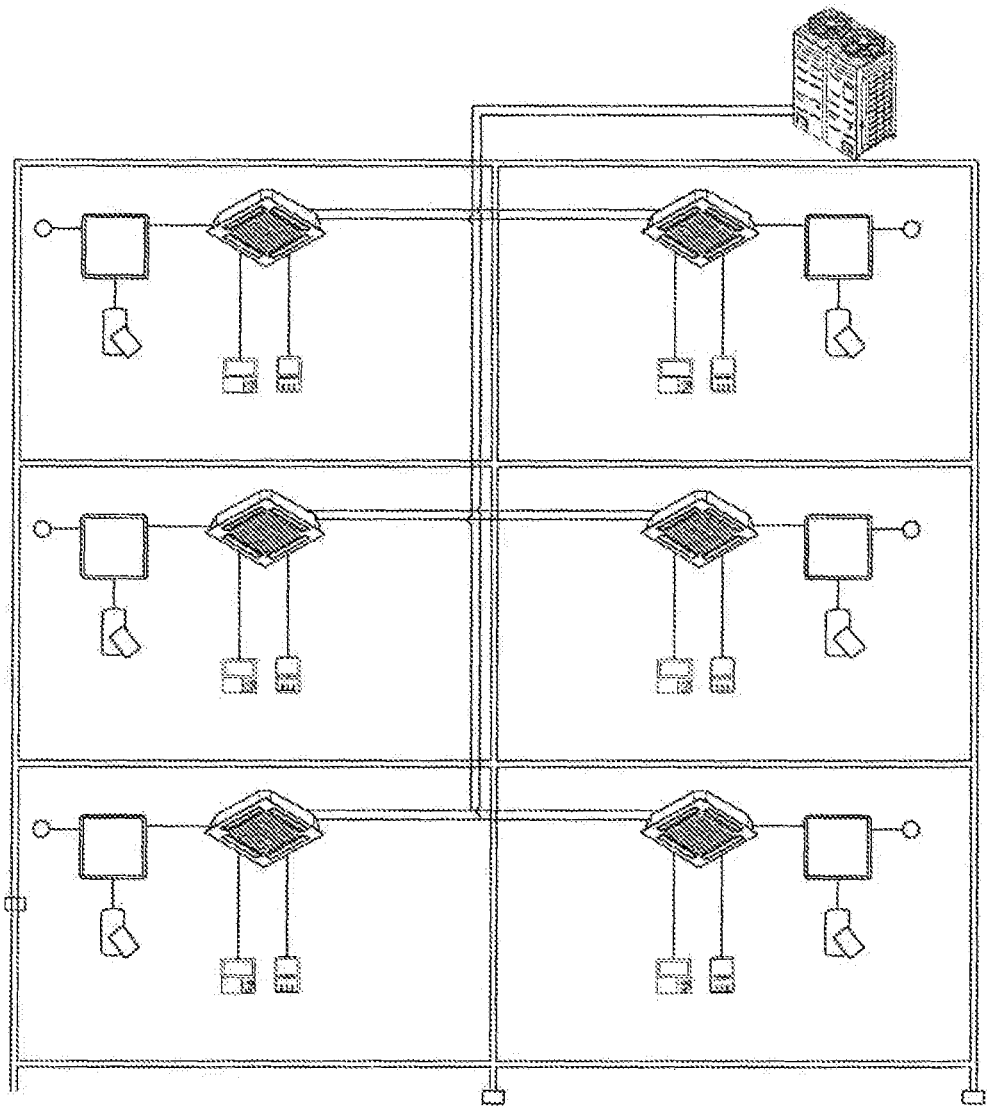
FIGS. 1A and 1B illustrate a refrigerant leakage system of a conventional air conditioner.
Figure 1B:
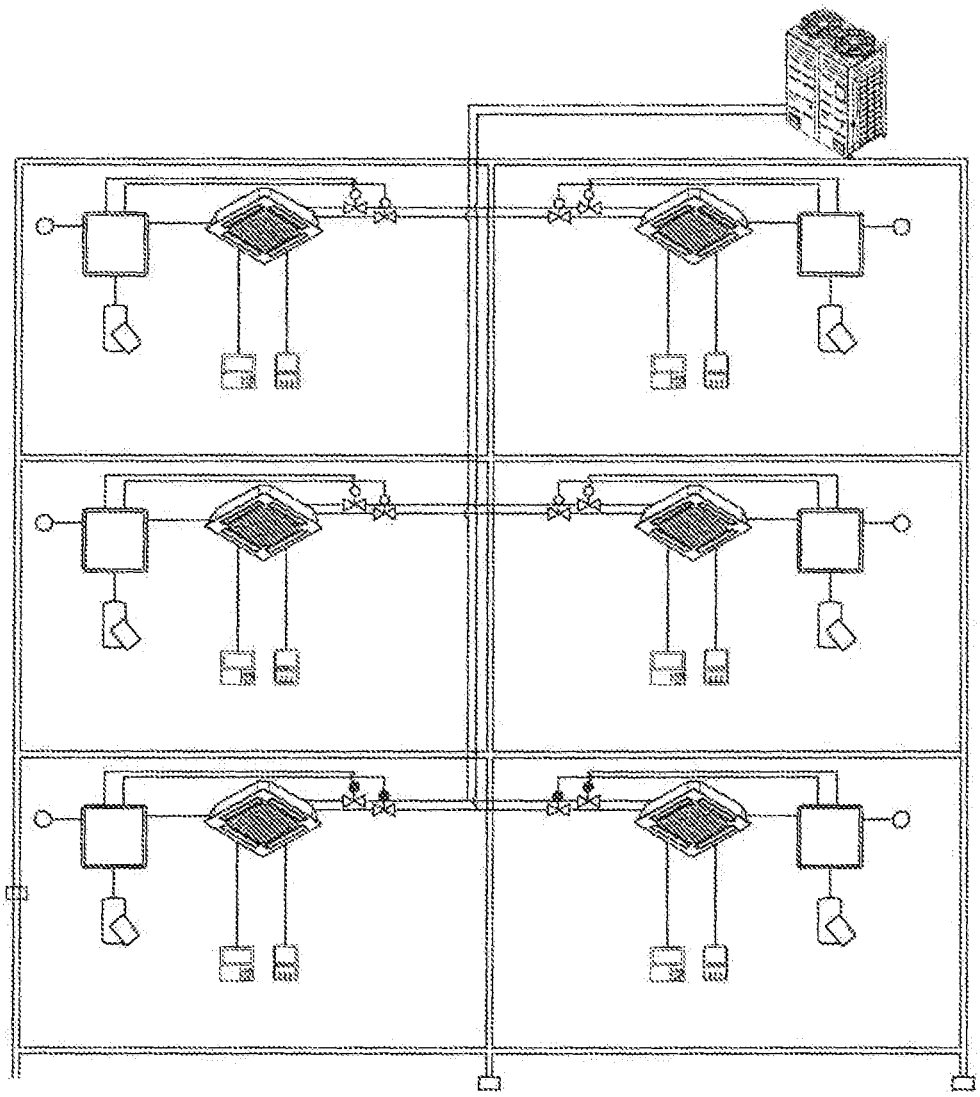

Advantages and features of the present disclosure and methods of achieving them will become apparent with reference to the embodiments described below in detail in conjunction with the accompanying drawings. However, the present disclosure is not limited to the embodiments disclosed below, but may be implemented in various different forms, and these embodiments are provided only to allow the disclosure of the present disclosure to be complete, and to completely inform those of ordinary skill in the art to which the present disclosure belongs, the scope of the invention, and the present disclosure is only defined by the scope of the claims. Like reference numerals refer to like elements throughout.

The terms spatially relative, "below", "beneath", "lower", "above" and "upper" and the like can be used to easily describe the correlation of elements with other elements. Spatially relative terms should be understood in terms of the directions shown in the drawings, including the different directions of components at the time of use or operation. For example, when inverting an element shown in the drawings, an element described as "below" or "beneath" of another element may be placed "above" of another element. Thus, the exemplary term "below" may include both downward and upward directions. The elements may also be oriented in a different direction, so that spatially relative terms can be interpreted according to orientation.

The terminology used herein is for the purpose of illustrating embodiments and is not intended to restrict the invention. In this specification, singular forms include plural forms unless the context clearly dictates otherwise. It is noted that the terms "comprises" and/or "comprising" used in the specification mean that mentioned elements, steps, and/or operations do not exclude the presence or addition of one or more of other elements, steps, and/or operations.

Unless defined otherwise, all terms (including technical and scientific terms) used herein may be used in a sense commonly understood by a person having ordinary skill in the art to which the claimed invention pertains. In addition, commonly used predefined terms are not ideally or excessively interpreted unless explicitly defined otherwise.

In the drawings, the thicknesses and sizes of respective elements are exaggerated, omitted, or schematically shown for convenience and clarity of explanation. In addition, the size and area of each element do not entirely reflect actual size or area.

Hereinafter, a preferred embodiment of the present disclosure will be described with reference to the accompanying drawings.

Figure 3:
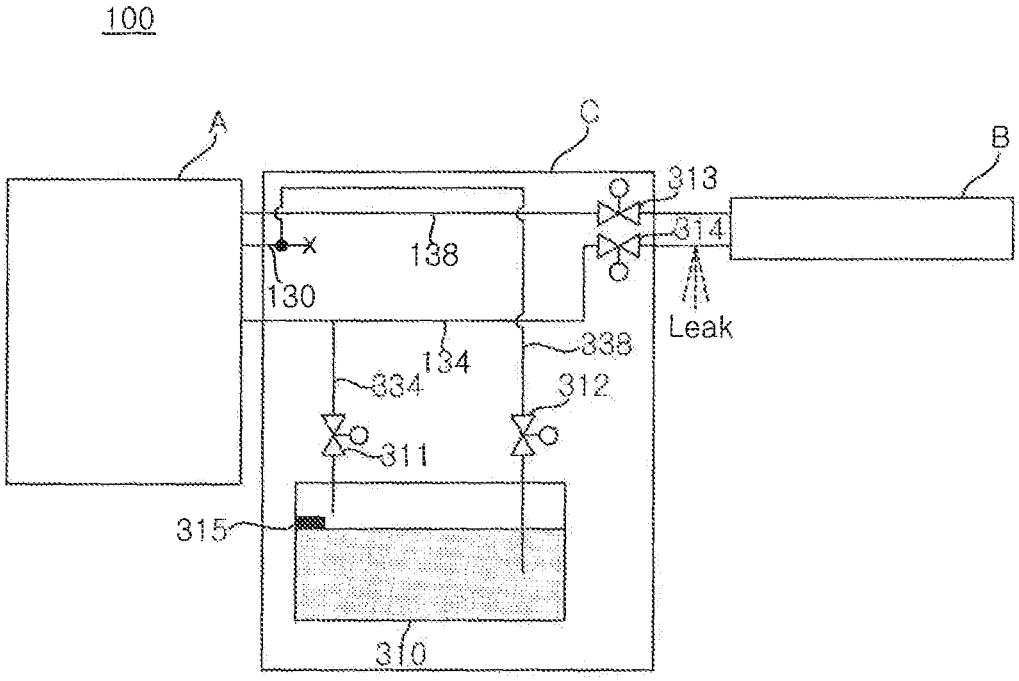
FIG. 3 is a schematic configuration diagram of a multi-air conditioner for heating/cooling operation according to an embodiment of the present disclosure.
Figure 4:
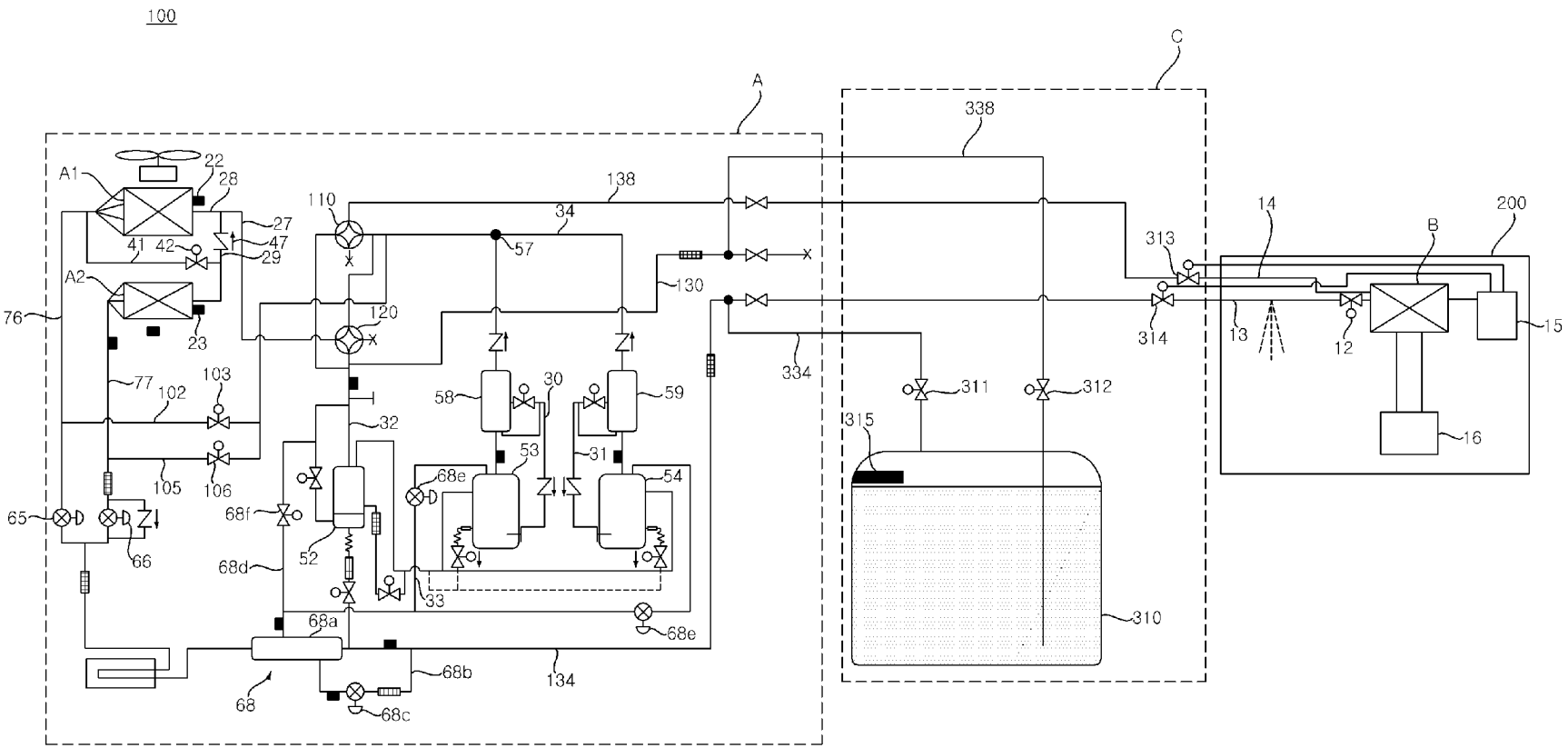
FIG. 4 is a detailed configuration diagram of the multi-air conditioner for heating/cooling operation of FIG. 3.

FIG. 3 is a schematic configuration diagram of a multi-air conditioner for heating/cooling operation according to an embodiment of the present disclosure, and FIG. 4 is a detailed configuration diagram of the multi-air conditioner for heating/cooling operation of FIG. 3.

Referring to FIGS. 3 and 4, a multi-air conditioner for heating/cooling operation 100 according to an embodiment of the present disclosure includes at least one indoor unit for heating and cooling B, an outdoor unit for heating and cooling A, and a buffer unit C.

The outdoor unit for heating and cooling A includes an outdoor unit case (not shown), and a compressor 53, 54, an outdoor heat exchanger A1, A2, an accumulator 52, a four-way valve 110, 120, an oil separator 58, 59, an outdoor expansion valve 65, 66, a hot gas unit 102, 105, and a supercooling unit 68 which are disposed inside the outdoor unit case.

The outdoor unit case includes an gas valve to which a gas connection pipe 138 is connected, and a liquid pipe valve to which a liquid connection pipe 134 is connected. In addition, the outdoor unit case according to the present embodiment may further include a common pipe 130 for connection to a plurality of outdoor units or simultaneous operation of a plurality of indoor units, and further includes a common pipe valve connected thereto. The liquid pipe valve and the gas valve are connected to the indoor unit B through an indoor liquid pipe 13 and an indoor gas pipe 14, and circulate the refrigerant of the outdoor unit A.

The compressors 53, 54 may be an inverter compressor capable of controlling the amount of refrigerant and the discharge pressure of the refrigerant by adjusting an operating frequency. The compressor according to the present embodiment may be divided into a first compressor 53 and a second compressor 54. The first compressor 53 and the second compressor 54 may be disposed in parallel. In the present embodiment, as shown in FIG. 4, it is described that two compressors 53 and 54 are provided, but this is just an embodiment, and it is also possible that various numbers of compressor 53, 54 are provided. In addition, the compressors 53 and 54 may be a compressor having a different capacity. Any one of the compressors 53 and 54 may be an inverter compressor with variable rotational speed, and the other compressor may be a constant speed compressor.

A bypass unit (shown by a dotted line) may be connected to each of the compressors 53 and 54 to discharge surplus oil to the outside of the compressor 53, 54, when excess oil is stored in the compressor 53, 54. The bypass unit includes a plurality of bypass pipes respectively connected to each of the compressors 53, 54, and a common pipe for allowing oil or refrigerant flowing along each bypass pipe to converge and flow. The common pipe may be connected to an accumulator discharge pipe 33.

The bypass pipe may be connected to each of the compressors 53 and 54 at a location which is higher than or equal to an oil level minimally required for the compressor 53 and 54. Depending on the oil level in the compressor 53 and 54, only the refrigerant, only the oil, or both the refrigerant and the oil may be discharged to the bypass pipe.

A depressurizing part for depressurizing the fluid discharged from the compressor 53, 54 and a valve for controlling the amount of fluid flowing through the bypass pipe may be installed in the bypass pipe.

The oil separator 58, 59 is disposed in the discharge side of the compressor 53, 54. The oil separator 58, 59 according to the present embodiment may be divided into a first oil separator 58 disposed in the discharge side of the first compressor 53 and a second oil separator 59 disposed in the discharge side of the second compressor 54. The refrigerant discharged from the compressor 53, 54 flows to the four-way valve 110, 120 through the oil separator 58, 59.

The oil separator 58, 59 recovers the oil contained in the discharged refrigerant and provides to the compressor 53, 54 again.

The oil separator 58, 59 further includes an oil recovery pipe 30, 31 for guiding oil to the compressor 53, 54 and a check valve which is disposed in the oil recovery pipe 30, 31 and allows the refrigerant to flow in one direction.

The oil separator 58, 59 is installed in a compressor discharge pipe 34.

An oil recovery structure capable of recovering oil to the compressor 53, 54 may also be disposed in the accumulator 52. An oil recovery pipe connecting the lower side of the accumulator 52 and the accumulator discharge pipe 33 and an oil recovery valve which is disposed in the oil recovery pipe to control the flow of oil may be disposed.

In the present embodiment, the outdoor heat exchanger A1, A2 include a first outdoor heat exchanger A1 and a second outdoor heat exchanger A2. An outdoor blowing fan 61 is disposed to improve heat exchange of the outdoor heat exchanger A1, A2.

The outdoor heat exchanger A1, A2 are connected to an outdoor heat exchanger-first four-way valve connection pipe 27 for flowing the refrigerant between a first four-way valve 110 and the outdoor heat exchanger A1, A2. The outdoor heat exchanger-first four-way valve connection pipe 27 includes a first outdoor heat exchanger-first four-way valve connection pipe 28 connecting the first outdoor heat exchanger A1 and the first four-way valve 110, and a second outdoor heat exchanger-first four-way valve connection pipe 29 connecting the second outdoor heat exchanger A2 and the first four-way valve 110. The outdoor heat exchanger-first four-way valve connection pipe 27 connected from the first four-way valve 110 is branched to the first outdoor heat exchanger-first four-way valve connection pipe 28 and the second outdoor heat exchanger-first four-way valve connection pipe 29.

A check valve is disposed in the second outdoor heat exchanger-first four-way valve connection pipe 29, and the check valve blocks the refrigerant supplied from the outdoor heat exchanger-first four-way valve connection pipe 27 from flowing into the second outdoor heat exchanger-four-way valve connection pipe 29.

A variable pass pipe 41 connecting the first outdoor heat exchanger pipe 76 and the second outdoor heat exchanger-first four-way valve connection pipe 29 are further disposed, and a variable pass valve 42 may be further disposed in the variable pass pipe 41.

The variable pass valve 42 may be selectively operated. When the variable pass valve 62 is opened, the refrigerant flowing along the first outdoor heat exchanger pipe 76 passes through the variable pass pipe 41 and the variable pass valve 42, and may be guided to the first four-way valve 110.

When the variable pass valve 42 is closed, the refrigerant supplied through the first outdoor heat exchanger pipe 76 flows to the first outdoor heat exchanger A1, during a heating operation.

When the variable pass valve 42 is closed, the refrigerant that passed through the first outdoor heat exchanger A1 flows to the liquid connection pipe 134 through the first outdoor heat exchanger pipe 76, during a cooling operation.

The outdoor expansion valve 65, 66 expands the refrigerant flowing into the outdoor heat exchanger A1, A2, during the heating operation. During the cooling operation, the outdoor expansion valve 65, 66 passes the refrigerant without expanding the refrigerant. An electronic expansion valve (EEV) capable of adjusting an opening value according to an input signal may be used as the outdoor expansion valve 65, 66.

The outdoor expansion valve 65, 66 includes a first outdoor expansion valve 65 that expands the refrigerant flowing into the first outdoor heat exchanger A1, and a second outdoor expansion valve 66 that expands the refrigerant flowing into the second outdoor heat exchanger A2.

The first outdoor expansion valve 65 and the second outdoor expansion valve 66 are connected to the liquid pipe connection pipe 134. During the heating operation, the refrigerant condensed in the indoor unit B is supplied to the first outdoor expansion valve 65 and the second outdoor expansion valve 66.

In order to be connected to the first outdoor expansion valve 65 and the second outdoor expansion valve 66, the liquid pipe connection pipe 134 is branched, and is connected to the first outdoor expansion valve 65 and the second outdoor expansion valve 66 respectively. The first outdoor expansion valve 65 and the second outdoor expansion valve 66 are disposed in parallel.

A pipe connecting the first outdoor expansion valve 65 and the first outdoor heat exchanger A1 is defined as a first outdoor heat exchanger pipe 76. A pipe connecting the second outdoor expansion valve 66 and the second outdoor heat exchanger A2 is defined as a second outdoor heat exchanger pipe 77.

The accumulator 52 provides refrigerant to the compressor 53, 54. The accumulator 52 is disposed in a suction side of the compressor 53, 54 and is connected to the four-way valve 110, 120.

The outdoor unit A according to the present embodiment may further include a receiver. The receiver may store liquid refrigerant to control the amount of circulated refrigerant. The receiver stores the liquid refrigerant separately from storing the liquid refrigerant in the accumulator 52.

The receiver supplies the refrigerant to the accumulator 52 when the amount of the circulated refrigerant is insufficient, and collects and stores the refrigerant when the amount of the circulated refrigerant is large.

A pipe connecting the outdoor expansion valves 65 and 66 and a supercooling heat exchanger 72 among the liquid pipe connection pipe 134 may be classified and defined as a supercooling liquid pipe connection pipe.

The four-way valve 110, 120 is provided in the outlet side of the compressor 53, 54, and switches the flow path of the refrigerant flowing in the outdoor unit A. The four-way valve 110, 120 appropriately switches the flow path of the refrigerant discharged from the compressor 53, 54 in accordance with the cooling/heating operation of the air conditioner 100.

The four-way valve 110, 120 according to the present embodiment may be divided into a first four-way valve 110 that sends the refrigerant discharged from the compressor 53, 54 to the outdoor heat exchanger A1, A2, or sends the refrigerant flowing in the outdoor heat exchanger A1, A2 to the compressor 53, 54 through the accumulator 52, and a second four-way valve 120 that sends the refrigerant discharged from the compressor 58, 59 to the gas pipe 138, or sends the refrigerant introduced from the gas pipe 138 to the compressor 53, 54 through the accumulator 52.

In addition, during the heating operation, the first four-way valve 110 in the side of the outdoor unit for heating operation sends the refrigerant introduced into the outdoor heat exchanger A1, A2 to the compressor 53, 54 and the gas connection pipe 138.

The first four-way valve 110 and the second four-way valve 120 according to this embodiment are set so that the refrigerant discharged from the compressor 53, 54 passes through the four-way valve 110, 120 in an off mode, and are set so that the refrigerant discharged from the compressor 53, 54 does not pass through the four-way valve 110, 120 in an on mode.

The air conditioner 1 according to the present embodiment maintains the first four-way valve 110 in the on mode, and maintains the second four-way valve 120 in the off mode during the cooling operation. The air conditioner 1 according to the present embodiment maintains the first four-way valve 110 in the off mode and maintains the second four-way valve 120 in the on mode during the heating operation.

The air conditioner 1 according to the present embodiment may include a hot gas unit 102, 105 in which a portion of the refrigerant compressed in the compressor 53, 54 flows. A portion of the high-temperature and high-pressure refrigerant compressed by the compressor 53, 54 may pass through the hot gas bypass pipe 102, 105 and may be introduced into the outdoor heat exchanger A1, A2.

The hot gas unit 102, 105 include a hot gas valve 103, 106 and a hot gas bypass pipe 102, 105 for bypassing the refrigerant.

In the present embodiment, a first hot gas bypass pipe 102 connecting the first outdoor heat exchanger pipe 76 and a compressor discharge pipe 34 is disposed. One end of the first hot gas bypass pipe 102 is connected to the first outdoor heat exchanger pipe 76, and the other end is connected to the compressor discharge pipe 34. A second hot gas bypass pipe 105 connecting the second outdoor heat exchanger pipe 77 and the compressor discharge pipe 34 is disposed. One end of the second hot gas bypass pipe 105 is connected to the first outdoor heat exchanger pipe 77, and the other end is connected to the compressor discharge pipe 34.

A first hot gas valve 103 is disposed in the first hot gas bypass pipe 102, and a second hot gas valve 106 is disposed in the second hot gas bypass pipe 105. A solenoid valve capable of adjusting the opening degree is used as the hot gas valve 103, 106, and an opening/closing valve also may be used.

Although the first hot gas bypass pipe 102 and the second hot gas bypass pipe 105 can be respectively connected to the compressor discharge pipe 34, but in the present embodiment, after being converged, are connected to the compressor discharge pipe 34 by a single pipe.

The supercooling unit 68 may be disposed in the liquid pipe connection pipe 134.

The supercooling unit 68 includes a supercooling heat exchanger 68*a*, a supercooling bypass pipe 68*b* that is bypassed in the liquid pipe connection pipe 134 and is connected to the supercooling heat exchanger 68*a*, a supercooling expansion valve 68*c* that is disposed in the supercooling bypass pipe 68*b* and selectively expands the flowing refrigerant, a supercooling-compressor connection pipe connecting the supercooling heat exchanger 68*a* and the compressor 53, 54, and a supercooling-compressor expansion valve 68*e* that is disposed in the supercooling-compressor connection pipe and selectively expands the flowing refrigerant.

The supercooling unit 68 according to the present embodiment further includes an accumulator bypass pipe 68*d* connecting the accumulator 52 and the supercooling-compressor connection pipe, and the accumulator bypass pipe 68*d* provides the refrigerant of the accumulator 52 to the supercooling-compressor connection pipe. The supercooling-compressor connection pipe is branched into a first supercooling-compressor connection pipe and a second supercooling-compressor connection pipe. A first supercooling-compressor expansion valve 68*e* is installed in the first supercooling-compressor connection pipe, and a second supercooling-compressor expansion valve 68*e* is installed in the second supercooling-compressor connection pipe.

A supercooling bypass valve 68*f* is further disposed in the accumulator bypass pipe 68*d*.

The supercooling expansion valve 68*f* expands the liquid refrigerant and provides it to the supercooling heat exchanger 68*a*, and the expanded refrigerant is evaporated in the supercooling heat exchanger 68*a* to cool the supercooling heat exchanger 68*a*. The liquid refrigerant flowing to the outdoor heat exchanger A1, A2 through the liquid pipe connection pipe 134 may be cooled while passing through the supercooling heat exchanger 68*a*. The supercooling expansion valve 68*f* is selectively operated and can control the temperature of the liquid refrigerant.

When the supercooling expansion valve 68*f* is operated, the supercooling-compressor expansion valve 68*e* is opened and the refrigerant flows to the compressor 53, 54.

The supercooling expansion valve 68*f* is selectively operated, and can provide the liquid refrigerant of the accumulator 52 to the supercooling-compressor expansion valve 68*e*.

The supercooling-compressor expansion valve 68*e* is selectively operated and expands the refrigerant to lower the temperature of the refrigerant supplied to the compressor 53, 54. When the compressor 53, 54 exceeds a normal operating temperature range, the refrigerant expanded in the supercooling-compressor expansion valve 68*e* may be evaporated in the compressor 53, 54, thereby lowering the temperature of the compressor 53, 54.

The air conditioner 100 according to the present embodiment may further include a pressure sensor for measuring the pressure of the refrigerant, a temperature sensor for measuring the temperature of the refrigerant, and a strainer for removing foreign substances existing in the refrigerant flowing through the refrigerant pipe.

The air conditioner 100 according to the present embodiment includes a common pipe 130 for connecting the outdoor unit A and the indoor unit B, and connecting the refrigerant pipe 134, 138 through which the refrigerant flows and the plurality of outdoor units A and the plurality of indoor units B.

The refrigerant pipe 134, 138 may be divided into a liquid pipe connection pipe 134 through which a liquid refrigerant flows, and a gas pipe connection pipe 138 through which a gaseous refrigerant flows.

The liquid pipe connection pipe 134 and the gas pipe connection pipe 138 are extended inside the outdoor unit A, and the common pipe 130 is also extended.

Meanwhile, at least one indoor unit B is installed in the room 200, and in the indoor unit B, an indoor expansion device (not shown) and the indoor heat exchanger B may be connected through the refrigerant pipe 13, 14. The indoor unit B may be installed to suck air from a room desiring an air conditioning, exchange heat with the indoor heat exchanger B, and then discharge it into the room desiring an air conditioning. An indoor fan for blowing indoor air to the indoor heat exchanger B may be installed in the indoor unit B.

In the room 200 in which at least one indoor unit B is installed, as an indoor refrigerant pipe connected to the indoor unit B, the indoor liquid pipe 13 connected to the liquid pipe connection pipe 134 and the indoor gas pipe 14 connected to the gas pipe connection pipe 138 are installed. In addition, an indoor expansion valve 12 is formed in the indoor liquid pipe 13 to flow a refrigerant to the indoor heat exchanger B.

In this case, each indoor unit B may further include a controller 15 that receives a control command, and a detection signal from the outside, and transmits to the outdoor unit A through wired/wireless communication.

In addition, a leak sensor 16 may be spaced apart from the indoor unit B and separately installed in the room 200 to detect a leak of the refrigerant, and the leak sensor 16 periodically detects whether the refrigerant exists in the room and transmits a corresponding detection signal to the controller 15.

Meanwhile, the air conditioner 100 according to an embodiment of the present disclosure further includes a buffer unit C on the refrigerant pipes 134, 138 between the indoor unit 200 in which the indoor unit B is installed and the outdoor unit A.

The buffer unit C is to reduce the amount of refrigerant leaking from the refrigerant pipe 134, 138, and includes a blocking valve 313, 314, a buffer tank 310, and a buffer valve 311, 312 that are installed on the refrigerant pipe 134, 138 outside the room 200 in which the indoor unit B is installed.

The blocking valve 313, 314 includes a gas pipe blocking valve 313 which is installed on the gas pipe connection pipe 138 connected to the indoor gas pipe 14, and when the refrigerant leaks from the room 200, blocks the refrigerant flow to the gas pipe connection pipe 138, and a liquid pipe blocking valve 314 which is installed on the liquid pipe connection pipe 134 connected to the indoor liquid pipe 13, and when the refrigerant leaks from the room 200, blocks the refrigerant flow to the liquid pipe connection pipe 134.

The gas pipe blocking valve 313 and the liquid pipe blocking valve 314 are a valve having a very large blocked flow rate, and may be a SOL valve that takes several tens of seconds to several minutes so as to achieve a complete blocking after receiving a control signal.

Figure 2A:
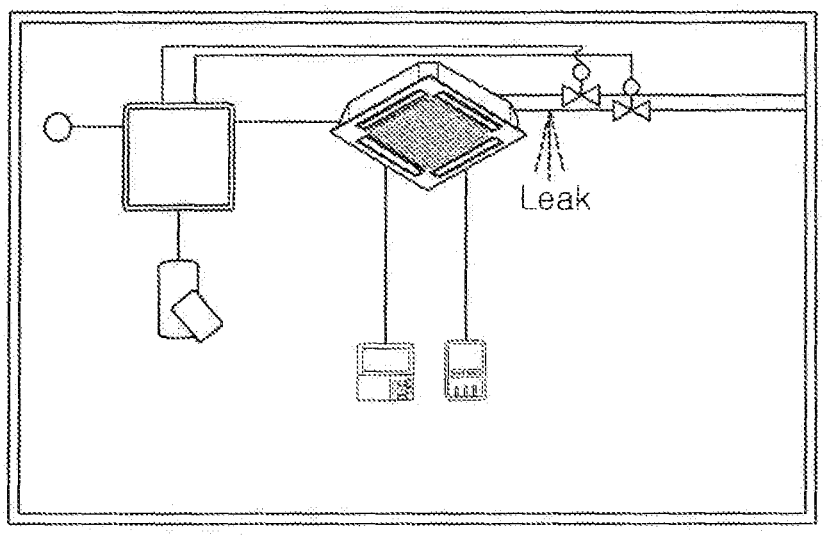
FIGS. 2A and 2B illustrate an air conditioner system including a refrigerant blocking valve of a conventional air conditioner.
Figure 2B:
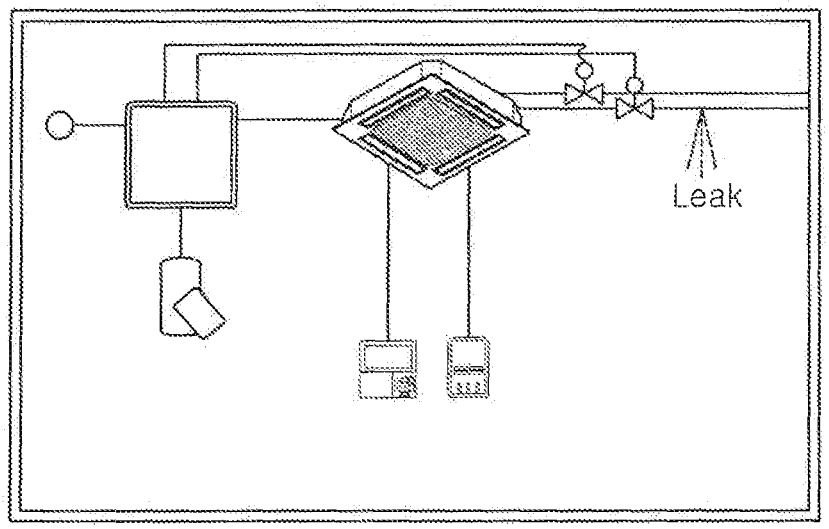

Therefore, when the gas pipe blocking valve 313 and the liquid pipe blocking valve 314 are installed indoors, if leakage occurs outside the blocking valve 313, 314 in a room as shown in FIG. 2B, even if the blocking valve 313, 314 is operated, leakage of the refrigerant flowing from the outdoor unit A cannot be prevented from flowing into the room 200.

Therefore, even if the situation shown in FIG. 2B occurs, the refrigerant blocking valve 313, 314 is formed on the refrigerant pipe 134, 138 outside the room 200 in which the indoor unit B is installed to prevent the leaking refrigerant from flowing into the room.

Meanwhile, the buffer tank 310 collects and stores the refrigerant leaking from the refrigerant pipes 134 and 138. The buffer tank 310 includes a water level sensor 315 on an inner wall of one side. When the water level of the collected refrigerant is a threshold value or more, the water level sensor 315 may transmit a detection signal to the outdoor unit A to inform that the collection of the leaked refrigerant is complete.

The buffer unit C includes a liquid pipe buffer pipe 334 connected to the liquid pipe connection pipe 134 and a low pressure buffer pipe 338 for setting a low pressure in the buffer tank 310 so as to collect the leaking refrigerant.

The liquid pipe buffer pipe 334 collects high-pressure refrigerant, and is connected to the front end of the liquid pipe connection valve in the outdoor unit A to collect the refrigerant of the liquid pipe connection pipe 134, and the low pressure buffer pipe 338 extends to the lower portion of the buffer tank 310 to set a low pressure in the tank 310. Due to such a pressure difference, the high-pressure refrigerant liquid in the high-pressure liquid pipe connection pipe 134 flows into the buffer tank 310 through the liquid pipe buffer pipe 334.

The low-pressure buffer pipe 338 may be preferably connected to the common pipe 130, but is not limited thereto, and may be connected to various low-pressure setting units that can be connected to an input terminal of the compressor 53, 54.

The buffer valve 311, 312 is formed on the low pressure buffer pipe 338 and the liquid pipe buffer pipe 334 respectively.

The buffer valve 311, 312 is opened or closed according to the control of the outdoor unit A to collect refrigerant along the pipe.

The buffer valve 311, 312 is a valve having a very rapid reaction speed in comparison with the refrigerant blocking valve 313, 314, and may be a general solenoid valve.

Hereinafter, a refrigerant leakage control during a cooling operation in a switchable air conditioner according to an embodiment of the present disclosure will be described with reference to FIGS. 5 and 6.

Figure 5:
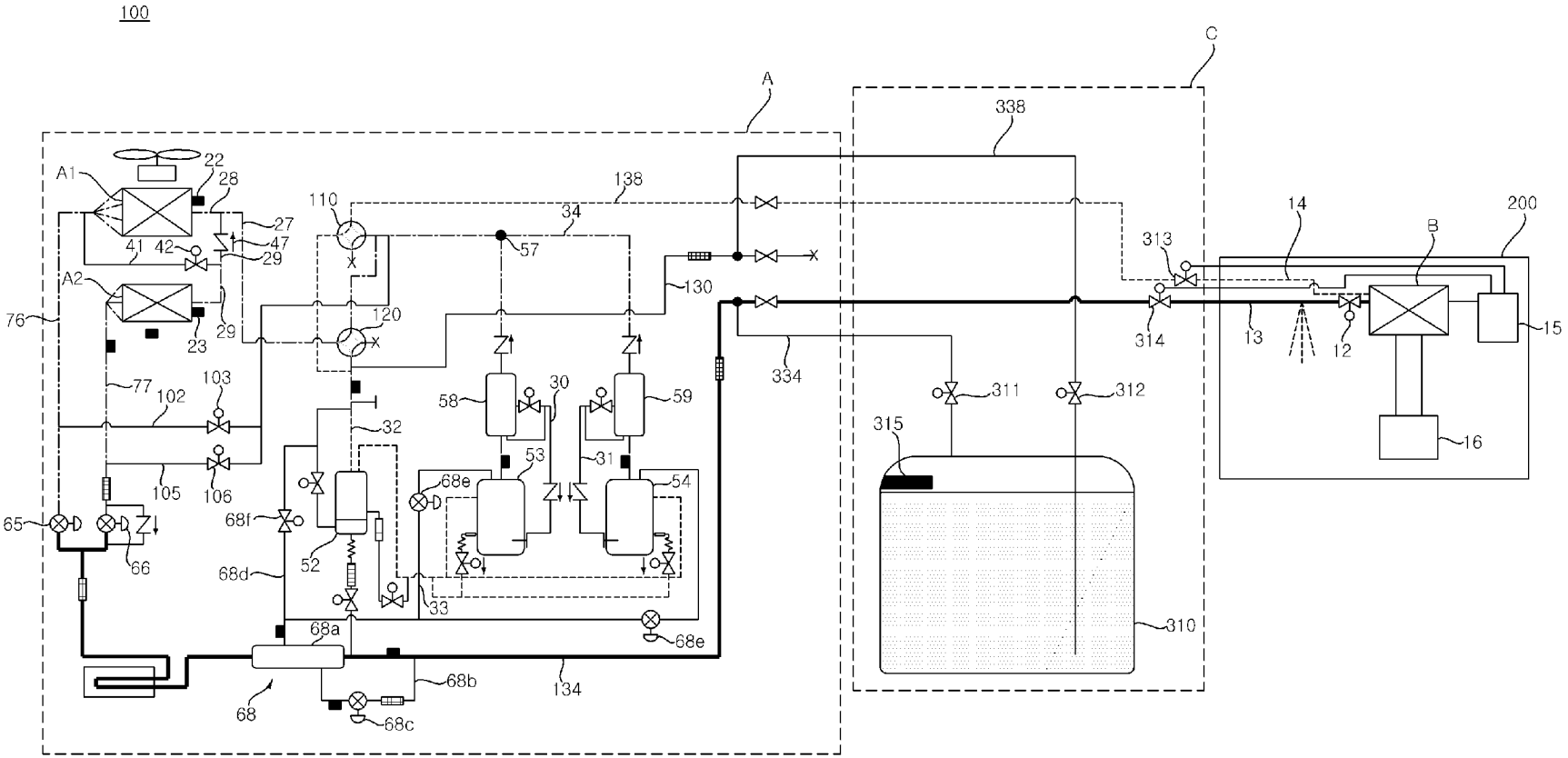
FIG. 5 is a switching-type cooling operation diagram of a multi-air conditioner for heating/cooling operation according to an embodiment of the present disclosure.
Figure 6:
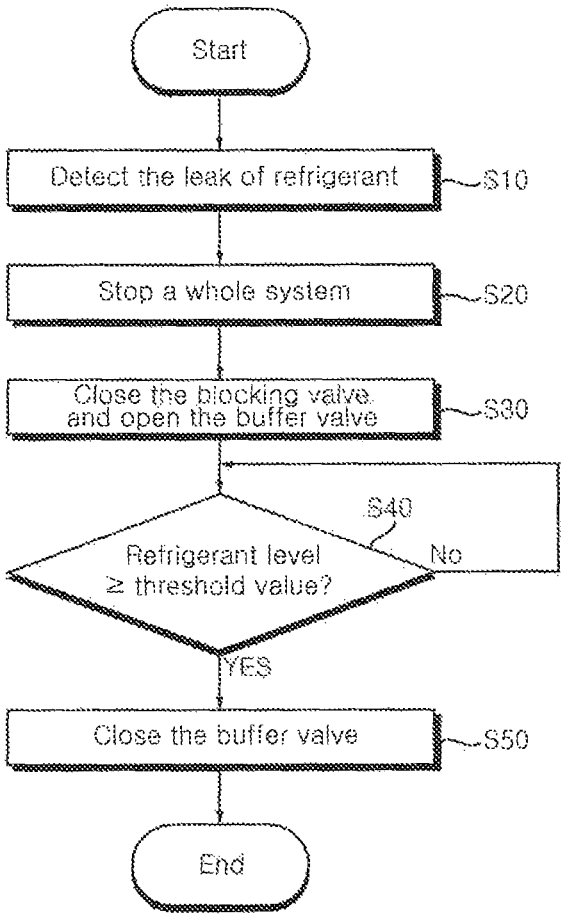
FIG. 6 is a flowchart of refrigerant leakage detection of a multi-air conditioner for heating/cooling operation according to an embodiment of the present disclosure.

FIG. 5 is a switching-type cooling operation diagram of a multi-air conditioner for heating/cooling operation according to an embodiment of the present disclosure, and FIG. 6 is a flowchart of refrigerant leakage detection of a multi-air conditioner for heating/cooling operation according to an embodiment of the present disclosure.

When the indoor unit is operating in a switchable cooling mode, the indoor unit fan rotates at a set wind speed, and the indoor expansion valve is opened to control target overheating. When the indoor unit B is stopped, the indoor unit fan is stopped, and the indoor expansion valve 12 is also closed.

In the cooling mode, the first outdoor heat exchanger A1 and the second outdoor heat exchanger A2 have the same connection relation between configurations. The outdoor heat exchangers A1 and A2 are all used as a condenser. The outdoor expansion valve 65, 66 are maximally opened.

The refrigerant flowing through the outdoor heat exchanger A1, A2 is a high-temperature and high-pressure refrigerant discharged from the compressor 53, 54, and the outdoor blowing fan 61 performs a target high-pressure control.

The first four-way valve 110 is set to an on mode in which the refrigerant discharged from the compressor 53, 54 does not pass through the first four-way valve 110. The second four-way valve 120 is set to an off mode in which the refrigerant discharged from the compressor 53, 54 passes through the second four-way valve 120. That is, the second four-way valve 120 connects the compressor discharge pipe 34 and the outdoor heat exchanger-first four-way valve connection pipe 27. The first four-way valve 110 sends the gaseous refrigerant introduced from the gas pipe connection pipe 138 to the compressor 53, 54. That is, the first four-way valve 110 connects the gas pipe connection pipe 138 and an accumulator inlet pipe 32.

In the cooling mode, the liquid pipe valve and the gas pipe valve are open, and the common pipe valve is closed.

In describing the flow of the refrigerant, the refrigerant discharged from the compressor 53, 54 flows to the outdoor heat exchanger A1, A2 through the second four-way valve 120. The refrigerant condensed in the outdoor heat exchanger A1, A2 flows through the liquid pipe connection pipe 134 and passes through the buffer unit C. The refrigerant flows into the indoor liquid pipe 13 of the room 200 through the liquid pipe connection pipe 134, flows to the indoor unit B to evaporate, and flows to the indoor gas pipe 14. The refrigerant flowing to the indoor gas pipe 14 flows to the first four-way valve 110 along the gas pipe connection pipe 138, and flows into the compressor 53, 54 through the accumulator 52.

When the leak of refrigerant is detected in such a flow, a refrigerant leak detection operation is performed as shown in FIG. 6.

Specifically, during cooling operation, when the high-temperature and high-pressure liquid refrigerant condensed in the outdoor unit A flows into the indoor unit B and is changed to a low-pressure gas through the expansion valve 12 in the indoor unit B, if leakage occurs in the liquid pipe 134, 13, first, a leak is detected in the leak sensor 16 installed in the room 200, which is transmitted as a detection signal to the controller 15 of the indoor unit B (S10).

When the controller 15 of the indoor unit B transmits a corresponding detection signal to a controller (not shown) of the outdoor unit A through an outdoor unit-indoor unit communication, the controller 15 of the outdoor unit A starts a refrigerant leak detection operation.

When a leak detection signal is received, the controller stops a whole system (S20).

That is, the operation of the compressor 53, 54 is stopped.

Next, the refrigerant blocking valve 313, 314 is closed to block the flow of the refrigerant flowing in each pipe conduit (S30).

At this time, the liquid pipe blocking valve 314 and the gas pipe blocking valve 313 are simultaneously blocked, and the closing time of the liquid pipe blocking valve 314 and the gas pipe blocking valve 313 takes about 90 to 120 seconds.

In order to prevent the refrigerant flowing through the liquid pipe connection pipe 134 from continuously leaking into the room 200 during a relatively long closing period as described above, the controller opens the buffer valve 311, 312.

When the buffer valves 311 and 312 of the buffer unit C are simultaneously opened, a low pressure is set in the bottom side of the buffer tank 310, and a high pressure is set in the inlet side from the liquid pipe buffer pipe 334 connected to the liquid connection pipe 134, so that the refrigerant in the high-pressure side is collected in the buffer tank 310.

Since the buffer valve 311, 312 is a solenoid valve that operates instantaneously, the buffer valve 311, 312 is opened rapidly to collect refrigerant in the buffer tank 310.

Accordingly, when the compressor 53, 54 is stopped, the refrigerant remaining in the high-pressure liquid pipe 314, 13 does not flow into the room, but is bypassed to the buffer tank 310 and collected, thereby blocking the refrigerant from leaking into the room 200.

At this time, the water level sensor 315 in the buffer tank 310 periodically detects the water level, and when the refrigerant level reaches a certain threshold value or higher, a corresponding detection signal is transmitted to the controller (S40).

In this case, the threshold value is the maximum value of the refrigerant that the buffer tank 310 can collect, and may indicate a refrigerant volume when all the refrigerants are collected in the liquid pipe 314, 13.

That is, when it is the threshold value or more, it can be determined that there is no refrigerant remaining in the pipe.

When receiving a corresponding detection signal from the water level sensor 315, the controller closes the buffer valve 311, 312 and notifies a maintenance request by transmitting the leak of refrigerant to a user or a manager (S50).

As described above, in the case where the refrigerant leaks, when using the refrigerant blocking valve 313, 314, a position of the refrigerant blocking valve 313, 314 is set to the outside of the room 200 to minimize the amount of refrigerant remaining in the room 200. Meanwhile, in order to reduce the amount of leakage until the blocking valve 313, 314 completes blocking, the remaining refrigerant is collected in the buffer tank 310, thereby dramatically reducing the amount of leakage while shortening the leakage time of the refrigerant leaking into the room.

Figure 7:
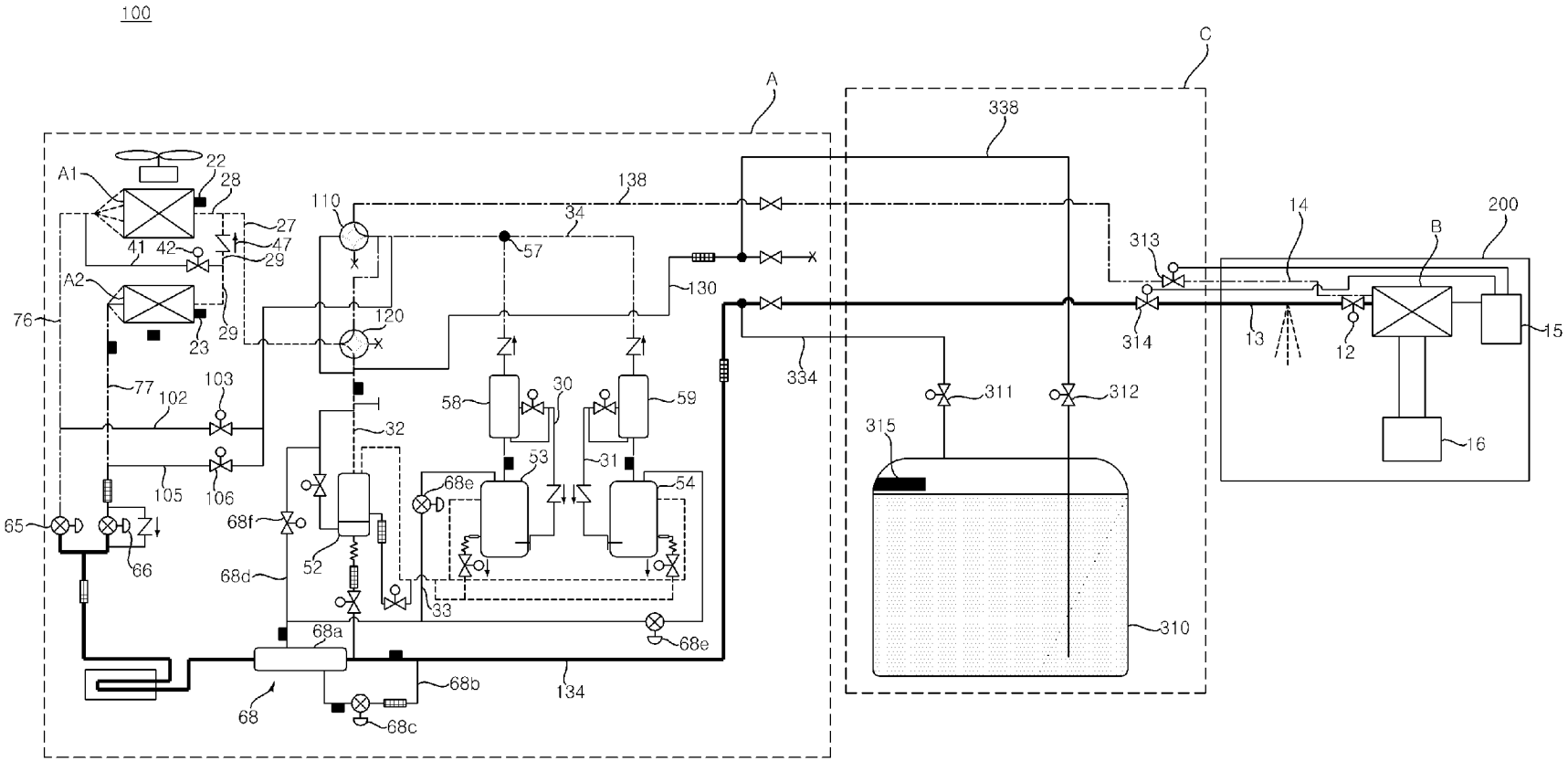
FIG. 7 is a switch-type heating operation diagram of a multi-air conditioner for heating/cooling operation according to an embodiment of the present disclosure.

FIG. 7 is a switch-type heating operation diagram of a multi-air conditioner for heating/cooling operation according to an embodiment of the present disclosure.

In the heating mode of the switchable air conditioner 100, when the indoor unit B is operating, the indoor unit fan rotates at a set wind speed, and the indoor expansion valve 12 is opened to control target overcooling. When the indoor unit B is stopped, the indoor unit fan may be stopped, and the indoor expansion valve 12 may be opened to prevent liquid from pooling.

In the heating mode, the first outdoor heat exchanger A1 and the second outdoor heat exchanger A2 have the same connection relation between configurations. The outdoor heat exchangers A1 and A2 are all used as an evaporator. The outdoor expansion valve 65, 66 is maximally opened.

In the heating mode, the compressor 53, 54 performs a target high pressure control. In the case of the heating mode, since the high pressure of cycle has an important effect on the heating performance, the operating frequency of the compressor 53, 54 can be decided to be formed in a pressure range in which a high pressure is set.

When the operating frequency of the compressor 53, 54 is increased, the high pressure may be increased, and when the operating frequency is decreased, the high pressure may be decreased. When the compressor 53, 54 is initially operated at a certain operating frequency, if the rising rate of the high pressure is smaller than a preset rising rate, the operating frequency of the compressor 53, 54 may be increased.

In the process of increasing the operating frequency of the compressor 53, 54, if the rising rate of the high pressure is smaller than the preset rising rate, the increasing rate of the operating frequency of the compressor 53, 54 may increase as time elapses. In this case, an increase rate of power consumption or current consumption of the air conditioner 100 may be relatively high.

The refrigerant flowing through the outdoor heat exchanger A1, A2 is a low pressure refrigerant flowing into the compressor 53, 54, and the outdoor blowing fan 61 performs a target low pressure control.

The second four-way valve 120 is set to an on-mode in which the refrigerant discharged from the compressor 53, 54 does not pass through the second four-way valve 120. The first four-way valve 110 is set to an off mode in which the refrigerant discharged from the compressor 53, 54 passes through the first four-way valve 110. The second four-way valve 120 connects the outdoor heat exchanger A1, A2 and the compressor 53, 54. That is, the second four-way valve 120 connects the outdoor heat exchanger-first four-way valve connection pipe 27 and the accumulator inlet pipe 32 so that the refrigerant discharged from the outdoor heat exchangers A1, A2 flows to the compressors 53, 54 through the accumulator 52. The first four-way valve 110 sends the refrigerant discharged from the compressor 53, 54 to the gas pipe connection pipe 138 connected to the indoor unit B. That is, the first four-way valve 110 connects the compressor discharge pipe 14 and the gas pipe connection pipe 138.

In the heating mode, the liquid pipe valve and the gas valve are open, and the common pipe valve is closed. Accordingly, the refrigerant does not flow into the common pipe 130.

In describing the flow of refrigerant in the heating mode, the refrigerant discharged from the compressor 53, 54 flows to the gas pipe connection pipe 138 through the first four-way valve 110. The refrigerant flowing through the gas pipe connection pipe 138 flows to the indoor unit B and is condensed. The refrigerant condensed in the indoor unit B flows into the outdoor unit A through the indoor liquid pipe 13 and the liquid pipe connection pipe 134. The refrigerant introduced into the outdoor unit A flows to the outdoor heat exchanger A1, A2 through the outdoor expansion valve 65, 66. The refrigerant evaporated in the outdoor heat exchanger A1, A2 flows to the second four-way valve 120, and flows to the compressor 53, 54 through the accumulator 30.

When the leak of refrigerant is detected in such a flow, a refrigerant leak detection operation is performed as shown in FIG. 6.

Specifically, when a leak occurs in the liquid pipe 134, 13 during heating operation, first, the leak is detected by the leak sensor 16 installed in the room 200, which is transmitted as a detection signal to the controller 15 of the indoor unit B (S10).

When the controller 15 of the indoor unit B transmits a corresponding detection signal to the controller of the outdoor unit A through outdoor unit-indoor unit communication, the controller 15 of the outdoor unit A starts a refrigerant leak detection operation.

When a leak detection signal is received, the controller stops a whole system (S20).

That is, the operation of the compressor 53, 54 is stopped.

Next, the refrigerant blocking valve 313, 314 is closed to block the flow of the refrigerant flowing in each pipe conduit (S30).

At this time, the liquid pipe blocking valve 314 and the gas pipe blocking valve 313 are simultaneously blocked, and the closing time of the liquid pipe blocking valve 314 and the gas pipe blocking valve 313 takes about 90 to 120 seconds.

In order to prevent the refrigerant flowing through the liquid pipe connection pipe 134 from continuously leaking into the room 200 during the relatively long closing period as described above, the controller opens the buffer valve 311, 312.

When the buffer valves 311 and 312 of the buffer unit C are simultaneously opened, a low pressure is set on the bottom side of the buffer tank 310, and a high pressure is set on the inlet side from the liquid pipe buffer pipe 334 connected to the liquid connection pipe 134, so that the refrigerant on the high-pressure side is collected in the buffer tank 310.

Since the buffer valve 311, 312 is a solenoid valve that operates instantaneously, the buffer valve 311, 312 is opened rapidly to collect refrigerant in the buffer tank 310.

Accordingly, when the compressor 53, 54 is stopped, the refrigerant remaining in the high-pressure liquid pipes 314 and 13 does not flow into the room, but is bypassed to the buffer tank 310 and collected, thereby blocking the refrigerant from leaking into the room 200.

At this time, the water level sensor 315 in the buffer tank 310 periodically detects the water level, and when the refrigerant level reaches a certain threshold value or higher, a corresponding detection signal is transmitted to the controller (S40).

When receiving a corresponding detection signal from the water level sensor 315, the controller closes the buffer valve 311, 312 and notifies a maintenance request by transmitting the leak of refrigerant to a user or a manager (S50).

As described above, in the case where the refrigerant leaks, when using the refrigerant blocking valve 313, 314, a position of the refrigerant blocking valve 313, 314 is set to the outside of the room 200 to minimize the amount of refrigerant remaining in the room 200.

Hereinafter, an embodiment in which the refrigerant leakage detection method of the present disclosure is applied to a simultaneous-type air conditioner will be described with reference to FIGS. 8 to 11.

Figure 8:
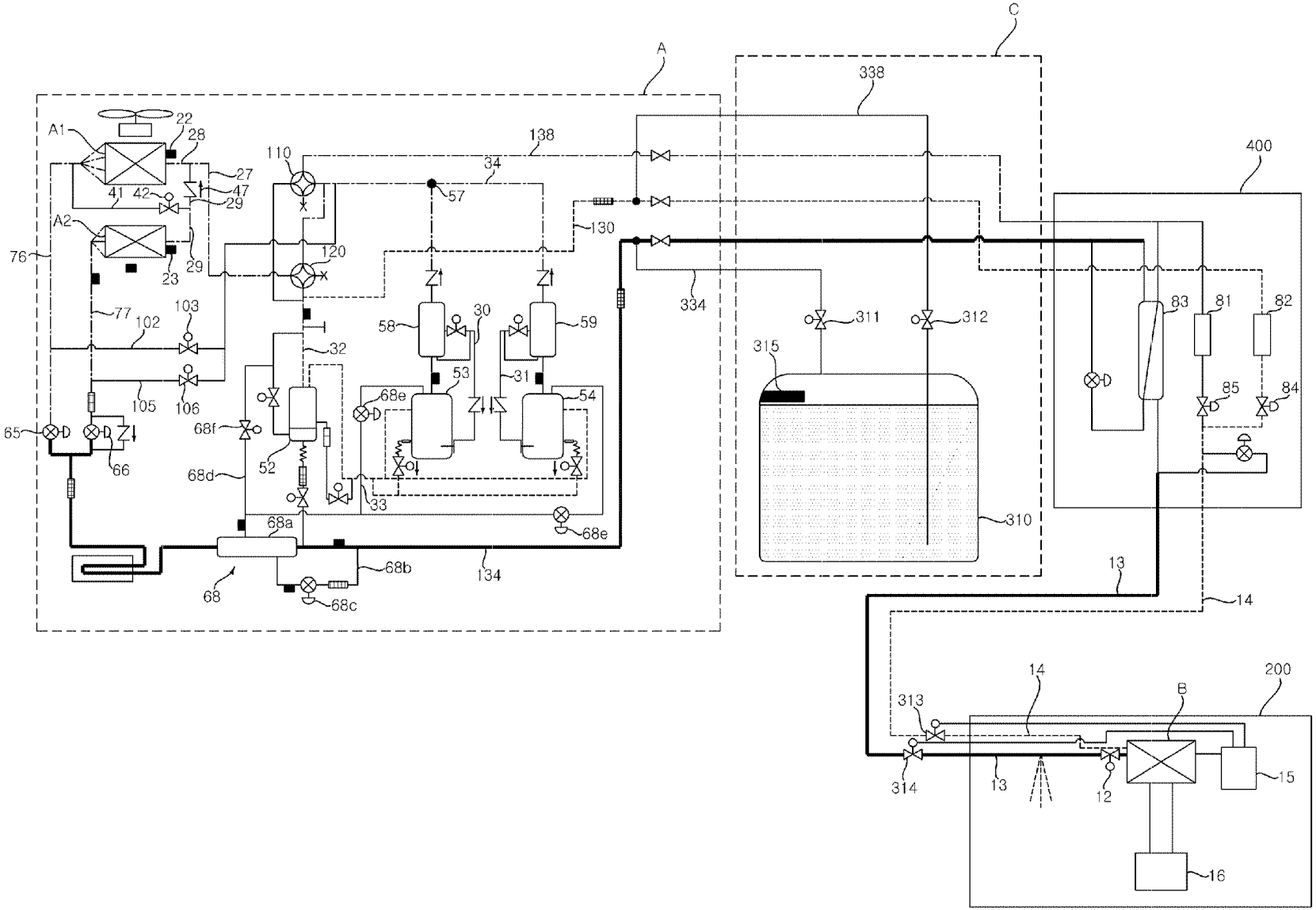
FIG. 8 is a simultaneous-type cooling dedicated operation diagram of a multi-air conditioner for heating/cooling operation according to another embodiment of the present disclosure.
Figure 9:
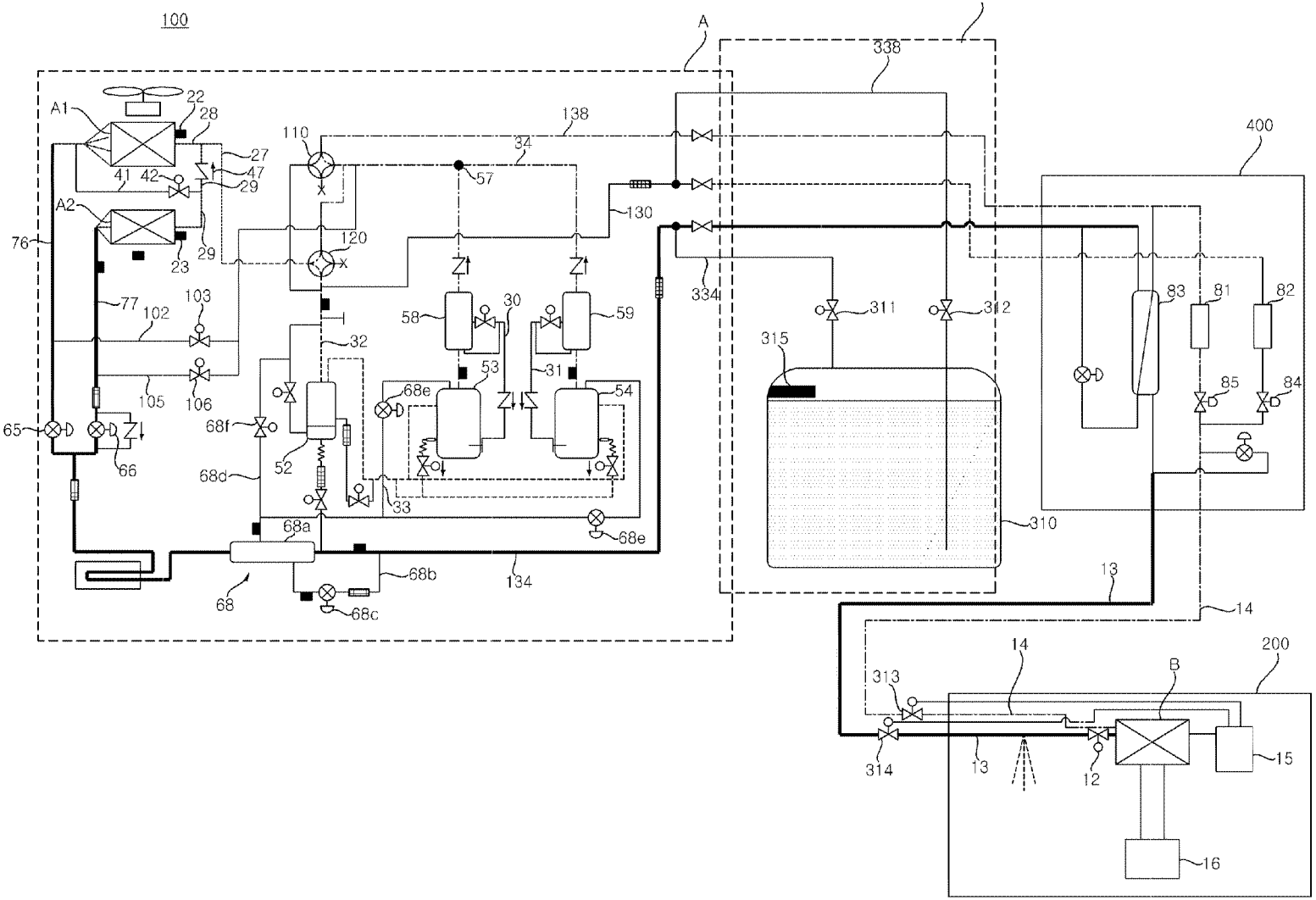
FIG. 9 is a simultaneous-type heating dedicated operation diagram of a multi-air conditioner for heating/cooling operation according to another embodiment of the present disclosure.

FIG. 8 is a simultaneous-type cooling dedicated operation diagram of a multi-air conditioner for heating/cooling operation according to another embodiment of the present disclosure, and FIG. 9 is a simultaneous-type heating dedicated operation diagram of a multi-air conditioner for heating/cooling operation according to another embodiment of the present disclosure.

Referring to FIGS. 8 and 9, the multi-air conditioner for heating/cooling operation according to another embodiment of the present disclosure includes at least one indoor unit B for heating/cooling operation, an outdoor unit A for heating/cooling operation, a distributor 400, and a buffer unit C.

The configurations of at least one indoor unit B for heating/cooling operation, the outdoor unit A for heating/cooling operation, and the buffer unit C are the same as those of the switching type of FIG. 4, and in the case of the simultaneous-type air conditioner, the distributor 400 is further included between the indoor units B and the outdoor unit A.

At this time, unlike FIG. 4, the common pipe 130 is a low-pressure connection pipe and is connected to the distributor 400.

The distributor 400 is disposed between the outdoor unit A for heating/cooling operation and at least one indoor unit B for heating/cooling operation, and distributes the refrigerant to the indoor unit B for heating/cooling operation according to the cooling and heating operation conditions.

Although a plurality of indoor units B may be connected in the present disclosure, a single indoor unit is illustrated in FIGS. 8 and 9 for convenience of explanation.

The distributor C includes a high pressure gas header 81, a low pressure gas header 82, a liquid header 83, and a control valve 84, 85.

The indoor electronic expansion valves 12 of the indoor unit are installed on indoor connection pipes 13 connecting the indoor heat exchanger B for heating/cooling operation and the high pressure gas header 81.

The high-pressure gas header 81 is connected to the gas pipe connection pipe 138 of a converging part 57 and one side of the indoor units B for heating/cooling operation, respectively. In addition, the low-pressure gas header 82 is connected to the common pipe 130 and connected to the other side of the indoor units B for heating/cooling operation. The liquid header 83 is connected to the supercooling unit 68 and one side of the indoor units B for heating/cooling operation, respectively. The high-pressure gas header 81, the low-pressure gas header 82, and the liquid header 83 may be further connected to each pipe of other outdoor unit (not shown), respectively. A low-pressure valve 84 is formed on the indoor gas pipes 14 to be connected to the low-pressure gas header 82, and a high-pressure valve 85 is formed on the indoor gas pipes 14 to be connected to the high-pressure gas header 81.

A bypass pipe (not shown) may be further installed between the low pressure valve 84 and the high pressure valve 85.

As shown in FIG. 8, when the cooling mode is performed on all of the plurality of indoor units B, the compressed high-temperature, high-pressure refrigerant of the compressor 53, 54 flows through the outdoor heat exchanger A1, A2 and is further condensed.

The first four-way valve 110 is set to an off mode in which the refrigerant discharged from the compressor passes through the first four-way valve 110. The second four-way valve 120 is set to an off mode in which the refrigerant discharged from the compressor 53, 54 passes through the second four-way valve. That is, the second four-way valve 120 connects the compressor discharge pipe 34 and the outdoor heat exchanger-first four-way valve connection pipe 27. The first four-way valve 110 flows a portion of the refrigerant compressed from the compressor discharge pipe 34 to the gas pipe connection pipe 138. Meanwhile, the accumulator inlet pipe 32 is branched into the common pipe 130, and a portion of the refrigerant flows to the accumulator inlet pipe 32 through the common pipe 130.

In the cooling mode, the liquid pipe valve, the gas pipe valve, and the common pipe valve are also opened.

In describing the flow of the refrigerant, the refrigerant discharged from the compressor 53, 54 flows to the outdoor heat exchanger A1, A2 through the second four-way valve 120. The refrigerant condensed in the outdoor heat exchanger A1, A2 flows through the liquid pipe connection pipe 134 and passes through the buffer unit C. The refrigerant flows into the indoor liquid pipe 13 of the room 200 through the liquid pipe connection pipe 134, flows into the indoor unit B and is evaporated, flows into the indoor gas pipe 14, is collected in the low pressure refrigerant header 82 by opening the low-pressure valve 84 of the distributor, and flows to the common pipe 130. The refrigerant flowing to the common pipe 130 flows into the compressor 53, 54 through the accumulator 52.

Even at this time, when the refrigerant leaks from the liquid pipe 13, 134, when the leak of refrigerant is detected in such a flow, the refrigerant leak detection operation is performed as shown in FIG. 6.

When a leak occurs in the liquid pipe 134, 13, first, the leak is detected by the leak sensor 16 installed in the room 200, which is transmitted as a detection signal to the controller 15 of the indoor unit B (S10).

When the controller 15 of the indoor unit B transmits a corresponding detection signal to the controller of the outdoor unit A through outdoor unit-indoor unit communication, the controller 15 of the outdoor unit A starts a refrigerant leak detection operation.

When a leak detection signal is received, the controller stops a whole system (S20).

That is, the operation of the compressor 53, 54 is stopped.

Next, all of the low pressure control valves 84 of the distributor 400 are opened so that the low pressure can be reliably obtained in the common pipe 130, and the high pressure control valve 85 is closed.

Further, the refrigerant blocking valve 313, 314 is closed to block the flow of the refrigerant flowing in each pipe conduit (S30).

At this time, the liquid pipe blocking valve 314 and the gas pipe blocking valve 313 are simultaneously blocked, and the closing time of the liquid pipe blocking valve 314 and the gas pipe blocking valve 313 takes about 90 to 120 seconds.

In order to prevent the refrigerant flowing through the liquid pipe connection pipe 134 from continuously leaking into the room 200 during a relatively long closing period as described above, the controller opens the buffer valve 311, 312.

When the buffer valves 311 and 312 of the buffer unit C are simultaneously opened, a low pressure is set on the bottom side of the buffer tank 310, and a high pressure is set on the inlet side from the liquid pipe buffer pipe 334 connected to the liquid connection pipe 134, so that the refrigerant of the high-pressure side is collected in the buffer tank 310.

Since the buffer valve 311, 312 is a solenoid valve that operates instantaneously, the buffer valve 311, 312 is opened rapidly to collect refrigerant in the buffer tank 310.

Accordingly, when the compressor 53, 54 is stopped, the refrigerant remaining in the high-pressure liquid pipe 314, 13 does not flow into the room, but is bypassed to the buffer tank 310 and collected, thereby blocking the refrigerant from leaking into the room 200.

At this time, the water level sensor 315 in the buffer tank 310 periodically detects the water level, and when the refrigerant level reaches a certain threshold value or higher, a corresponding detection signal is transmitted to the controller (S40).

When receiving a corresponding detection signal from the water level sensor 315, the controller closes the buffer valve 311, 312 and notifies a maintenance request by transmitting the leak of refrigerant to a user or a manager (S50).

As described above, in the case where the refrigerant leaks, when using the refrigerant blocking valve 313, 314, a position of the refrigerant blocking valve 313, 314 is set to the outside of the room 200 to minimize the amount of refrigerant remaining in the room 200.

Meanwhile, in the case of a heating-dedicated mode of FIG. 9, the compressed high-temperature and high-pressure refrigerant of the compressor 53, 54 flows into the indoor unit B and is condensed.

Specifically, the second four-way valve 120 is set to an on mode in which the refrigerant discharged from the compressor 53, 54 cannot pass through the second four-way valve 120. The first four-way valve 110 is set to an off mode in which the refrigerant discharged from the compressor 53, 54 passes through the first four-way valve 100. The second four-way valve 120 connects the outdoor heat exchanger A1, A2 to the compressor 53, 54. That is, the second four-way valve 120 connects the outdoor heat exchanger-first four-way valve connection pipe 27 and the accumulator inlet pipe 32 so that the refrigerant discharged from the outdoor heat exchanger A1, A2 flows to the compressor 53, 54 through the accumulator 52. The first four-way valve 110 sends the refrigerant discharged from the compressor 53, 54 to the gas pipe connection pipe 138 connected to the indoor unit B. That is, the first four-way valve 110 connects the compressor discharge pipe 14 and the gas pipe connection pipe 138. Meanwhile, the accumulator inlet pipe 32 is branched into the common pipe 130, and a portion of the refrigerant from the indoor unit B flows to the accumulator inlet pipe 32 through the common pipe 130.

In the heating mode, the liquid pipe valve, the gas pipe valve, and the common pipe valve are also opened.

In describing the flow of refrigerant in the heating mode, the refrigerant discharged from the compressor 53, 54 flows to the gas pipe connection pipe 138 through the first four-way valve 110. The refrigerant flowing through the gas pipe connection pipe 138 flows into the indoor unit B by opening the high-pressure control valve 85 of the distributor 400, and is condensed. The refrigerant condensed in the indoor unit B flows into the indoor liquid pipe 13 and the liquid header 83, and flows into the outdoor unit A through the liquid pipe connection pipe 134. The refrigerant introduced into the outdoor unit A flows to the outdoor heat exchangers A1, A2 through the outdoor expansion valve 65, 66. The refrigerant evaporated in the outdoor heat exchanger A1, A2 flows to the second four-way valve 120, and flows to the compressor 53, 54 through the accumulator 30.

When a leak of refrigerant is detected in such a flow, a refrigerant leak detection operation is performed as shown in FIG. 6.

Specifically, when a leak occurs in the liquid pipe 134, 13 during heating operation, first, the leak is detected by the leak sensor 16 installed in the room 200, which is transmitted as a detection signal to the controller 15 of the indoor unit B (S10).

When the controller 15 of the indoor unit B transmits a corresponding detection signal to the controller of the outdoor unit A through outdoor unit-indoor unit communication, the controller 15 of the outdoor unit A starts a refrigerant leak detection operation.

When a leak detection signal is received, the controller stops a whole system (S20).

That is, the operation of the compressor 53, 54 is stopped.

Next, all of the high-pressure control valves 85 of the distributor 400 are opened, and the low-pressure control valve 84 is closed.

Further, the refrigerant blocking valve 313, 314 is closed to block the flow of the refrigerant flowing in each pipe conduit (S30).

At this time, the liquid pipe blocking valve 314 and the gas pipe blocking valve 313 are simultaneously blocked, and the buffer valve 311, 312 is opened.

When the buffer valves 311 and 312 of the buffer unit C are simultaneously opened, a low pressure is set on the bottom side of the buffer tank 310, and a high pressure is set on the inlet side from the liquid pipe buffer pipe 334 connected to the liquid connection pipe 134, so that the refrigerant on the high-pressure side is collected in the buffer tank 310.

Since the buffer valve 311, 312 is a solenoid valve that operates instantaneously, the buffer valve 311, 312 is opened rapidly to collect refrigerant in the buffer tank 310.

Accordingly, when the compressor 53, 54 is stopped, the refrigerant remaining in the high-pressure liquid pipes 314 and 13 does not flow into the room, but is bypassed to the buffer tank 310 and collected, thereby blocking the refrigerant from leaking into the room 200.

At this time, the water level sensor 315 in the buffer tank 310 periodically detects the water level, and when the refrigerant level reaches a certain threshold value or higher, a corresponding detection signal is transmitted to the controller (S40).

At this time, the water level sensor 315 in the buffer tank 310 periodically detects the water level, and when the refrigerant level reaches a certain threshold value or higher, a corresponding detection signal is transmitted to the controller (S40).

Hereinafter, the simultaneous-type heating main operation and cooling main operation of the multi-air conditioner for heating/cooling operation will be described with reference to FIGS. 10 and 11.

Figure 10:
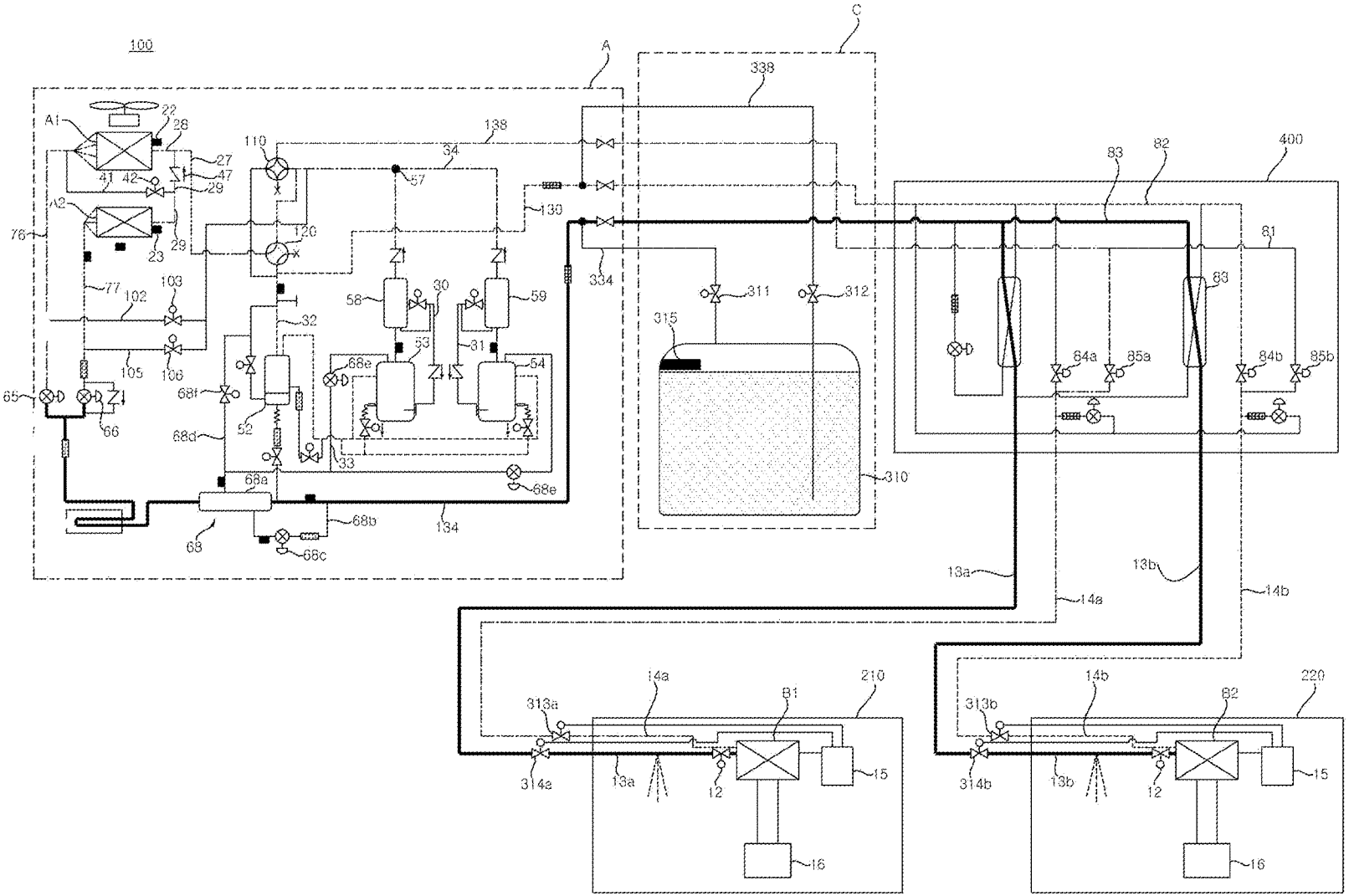
FIG. 10 is a simultaneous-type heating main operation diagram of a multi-air conditioner for heating/cooling operation according to another embodiment of the present disclosure.
Figure 11:
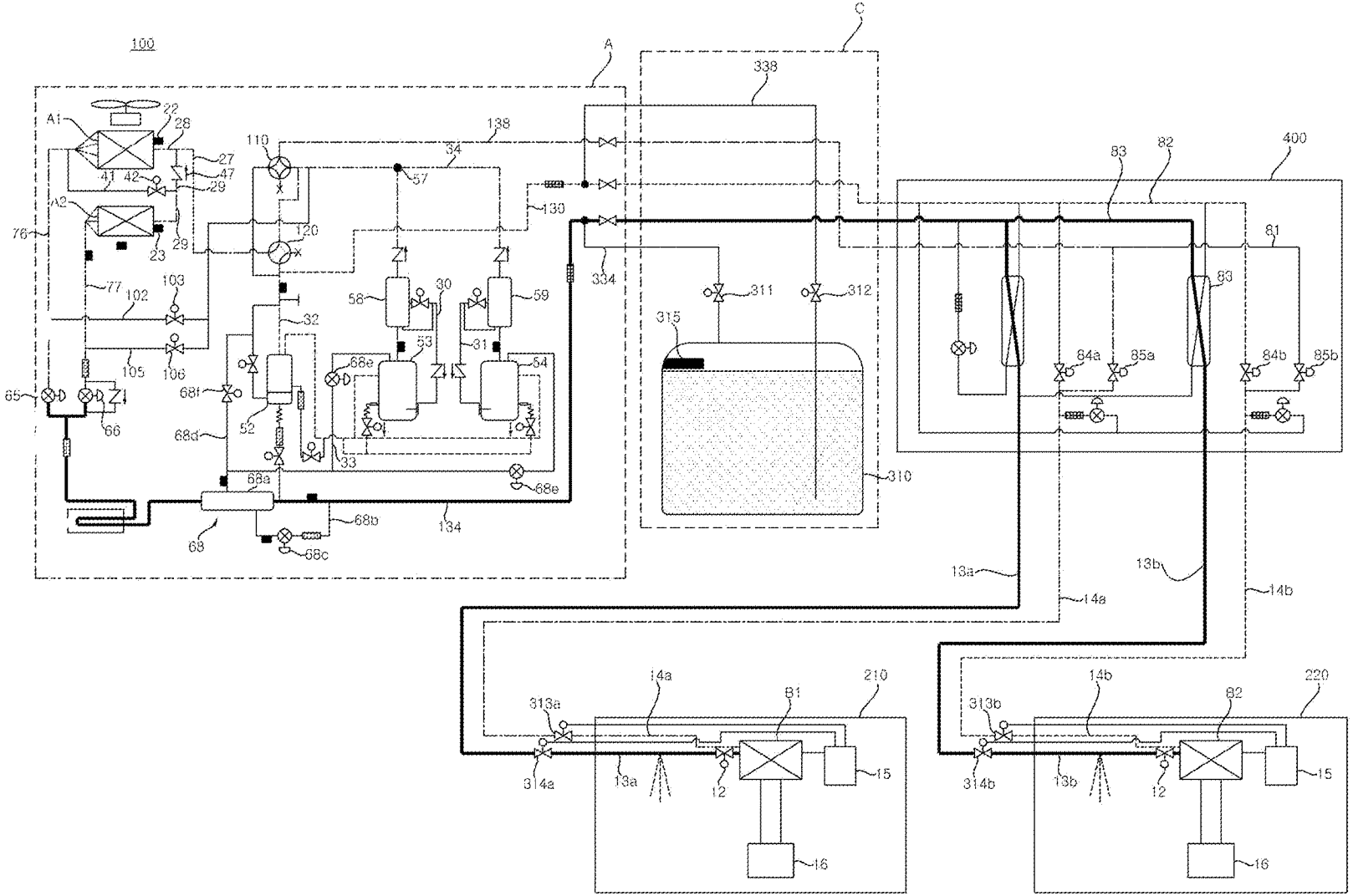
FIG. 11 is a simultaneous-type cooling main operation diagram of a multi-air conditioner for heating/cooling operation according to another embodiment of the present disclosure.

FIG. 10 is a simultaneous-type heating main operation diagram of a multi-air conditioner for heating/cooling operation according to another embodiment of the present disclosure, and FIG. 11 is a simultaneous-type cooling main operation diagram of a multi-air conditioner for heating/cooling operation according to another embodiment of the present disclosure.

In the case of the simultaneous-type heating/cooling main operation of the multi-air conditioner for heating/cooling operation according to another embodiment of FIG. 10, a plurality of indoor units B1 and B2 are assigned by the distributor to flow the refrigerant.

Most configurations are the same as those of FIGS. 8 and 9, but configurations of the distributor 400 and the indoor unit B1, B2 are partially different.

Specifically, a plurality of indoor units B1 and B2 having the same configuration may be connected at the same time, and the distributor 400 includes the low pressure control valve 84*a*, 84*b* and the high pressure control valve 85*a*, 85*b* that are connected to the indoor liquid pipe 13*a*, 13*b* and the indoor gas pipe 14*a*, 14*b*, with respect to each indoor unit B1, B2.

Accordingly, the liquid pipe control valve 84*a*, 84*b* and the high pressure control valve 85*a*, 85*b* are opened and closed according to the mode of each indoor unit B1, B2 to flow or block the refrigerant.

In addition, refrigerant blocking valves 314*a*, 314*b*, 313*a*, and 313*b* may be respectively installed in the outside of the room 210, 220 in which the indoor unit B1, B2 is installed.

Assuming that when the heating main operation mode of the simultaneous-type multi-air conditioner for heating/cooling operation 100 is performed, the first indoor unit B1 operates in the heating mode and the second indoor unit B2 operates in the cooling mode, as shown in FIG. 10.

The flow of the refrigerant for operating the first indoor unit B1 in the heating mode is the same as the flow of the refrigerant in a whole heating operation. However, after flowing into the second indoor unit B2 through the second indoor liquid pipe 13*b* from the liquid header 83, the high-pressure liquid refrigerant expands by the second indoor electronic expansion valve 12, evaporates in the second indoor heat exchanger B2, and then flows into the low-pressure gas header 82. Thereafter, the refrigerant flows through the common pipe 130, and then flows into the accumulator 30, and is mixed with the refrigerant evaporated in the outdoor heat exchanger A1, A2.

When a leak of refrigerant is detected in such a flow, a refrigerant leak detection operation is performed as shown in FIG. 6.

Specifically, when a leak occurs in the liquid pipe 13*a*, 13*b* of a specific room 210, 220 during the heating main operation, first, the leak is detected by the leak sensor 16 installed in a corresponding room 210, 220, which is transmitted as a detection signal to the controller 15 of the indoor unit B (S10).

When the controller 15 of the indoor unit B transmits a corresponding detection signal to the controller of the outdoor unit A through outdoor unit-indoor unit communication, the controller 15 of the outdoor unit A starts a refrigerant leak detection operation.

When a leak detection signal is received, the controller stops a whole system (S20).

That is, the operation of the compressor 53, 54 is stopped.

Next, all of the high pressure control valves 85*a* of the indoor unit B1 in the heating mode of the distributor 400 are opened, and the low pressure control valve 84*a* is closed. Meanwhile, all of the low pressure control valves 84*b* of the indoor unit B2 in the cooling mode are opened, and the high pressure control valve 85*b* is closed.

Further, the refrigerant blocking valve 313, 314 is closed to block the flow of the refrigerant flowing in each pipe conduit (S30).

At this time, the liquid pipe blocking valve 314*a*, 314*b* and the gas pipe blocking valve 313*a*, 313*b* are simultaneously blocked, and the buffer valve 311, 312 is opened.

When the buffer valves 311 and 312 of the buffer unit C are simultaneously opened, a low pressure is set in the bottom side of the buffer tank 310, and a high pressure is set in the inlet side from the liquid pipe buffer pipe 334 connected to the liquid pipe connection pipe 134, so that the refrigerant in the high-pressure side is collected in the buffer tank 310.

Since the buffer valve 311, 312 is a solenoid valve that operates instantaneously, the buffer valve 311, 312 is opened rapidly to collect refrigerant in the buffer tank 310.

Accordingly, when the compressor 53, 54 is stopped, the refrigerant remaining in the high-pressure liquid pipe 314, 13 does not flow into the room, but is bypassed to the buffer tank 310 and collected, thereby blocking the refrigerant from leaking into the room 200.

At this time, the water level sensor 315 in the buffer tank 310 periodically detects the water level, and when the refrigerant level reaches a certain threshold value or higher, a corresponding detection signal is transmitted to the controller (S40).

When receiving a corresponding detection signal from the water level sensor 315, the controller closes the buffer valve 311, 312 and notifies a maintenance request by transmitting the leak of refrigerant to a user or a manager (S50).

Meanwhile, in the case of the cooling main operation mode, the flow of the refrigerant is shown as in FIG. 11.

For example, it is assumed that the first indoor unit B1 operates in the heating mode and the second indoor unit B2 operates in the cooling mode.

The flow of the refrigerant for operating the second indoor unit B2 in the cooling mode is the same as the flow of the refrigerant during the whole cooling operation.

A portion of the high-pressure gas refrigerant discharged from the first and second compressors 53, 54 passes through the converging part 57 and flows through the gas pipe connection pipe 138 through the first four-way valve 110, and then flows into the high-pressure gas header 81. The refrigerant flowing out from the high-pressure gas header 81 flows through the first indoor gas pipe 14*a*, and then is condensed in the first indoor heat exchanger B1, and flows into the liquid header 83. Both the refrigerant passing through the first indoor unit B1 and the refrigerant that passes through the outdoor heat exchanger A1, A1 to flow out to the second indoor unit B2 are introduced into the liquid header 83.

When the leak of refrigerant is detected in such a flow, a refrigerant leak detection operation is performed as shown in FIG. 6.

Specifically, when a leak occurs in the liquid pipe 13*a*, 13*b* of a specific room 210, 220 during the cooling main operation, first, the leak is detected by the leak sensor 16 installed in a corresponding room 210, 220, which is transmitted as a detection signal to the controller 15 of the indoor unit B1, B2 (S10).

When the controller 15 of the indoor unit B1, B2 transmits a corresponding detection signal to the controller of the outdoor unit A through outdoor unit-indoor unit communication, the controller of the outdoor unit A starts a refrigerant leak detection operation.

When a leak detection signal is received, the controller stops a whole system (S20).

That is, the operation of the compressor 53, 54 is stopped.

Next, all of the high pressure control valves 85*a* of the indoor unit B1 in the heating mode of the distributor 400 are opened, and the low pressure control valve 84*a* is closed. Meanwhile, all of the low pressure control valves 84*b* of the indoor unit B2 in the cooling mode are opened, and the high pressure control valve 85*b* is closed.

Further, the refrigerant blocking valve 313*a*, 313*b* is closed to block the flow of the refrigerant flowing in each pipe conduit (S30).

At this time, the liquid pipe blocking valve 314*a*, 314*b* and the gas pipe blocking valve 313*a*, 313*b* are simultaneously blocked, and the buffer valve 311, 312 is opened.

When the buffer valves 311 and 312 of the buffer unit C are simultaneously opened, a low pressure is set in the bottom side of the buffer tank 310, and a high pressure is set in the inlet side from the liquid pipe buffer pipe 334 connected to the liquid pipe connection pipe 134, so that the refrigerant in the high-pressure side is collected in the buffer tank 310.

Since the buffer valve 311, 312 is a solenoid valve that operates instantaneously, the buffer valve 311, 312 is opened rapidly to collect refrigerant in the buffer tank 310.

Accordingly, when the compressor 53, 54 is stopped, the refrigerant remaining in the high-pressure liquid pipe 314, 13 does not flow into the room, but is bypassed to the buffer tank 310 and collected, thereby blocking the refrigerant from leaking into the room 200.

At this time, the water level sensor 315 in the buffer tank 310 periodically detects the water level, and when the refrigerant level reaches a certain threshold value or higher, a corresponding detection signal is transmitted to the controller (S40).

When receiving a corresponding detection signal from the water level sensor 315, the controller closes the buffer valve 311, 312 and notifies a maintenance request by transmitting the leak of refrigerant to a user or a manager (S50).

Hereinafter, a leak detection operation during stop of the present disclosure will be described with reference to FIGS. 12 to 14.

Figure 12:
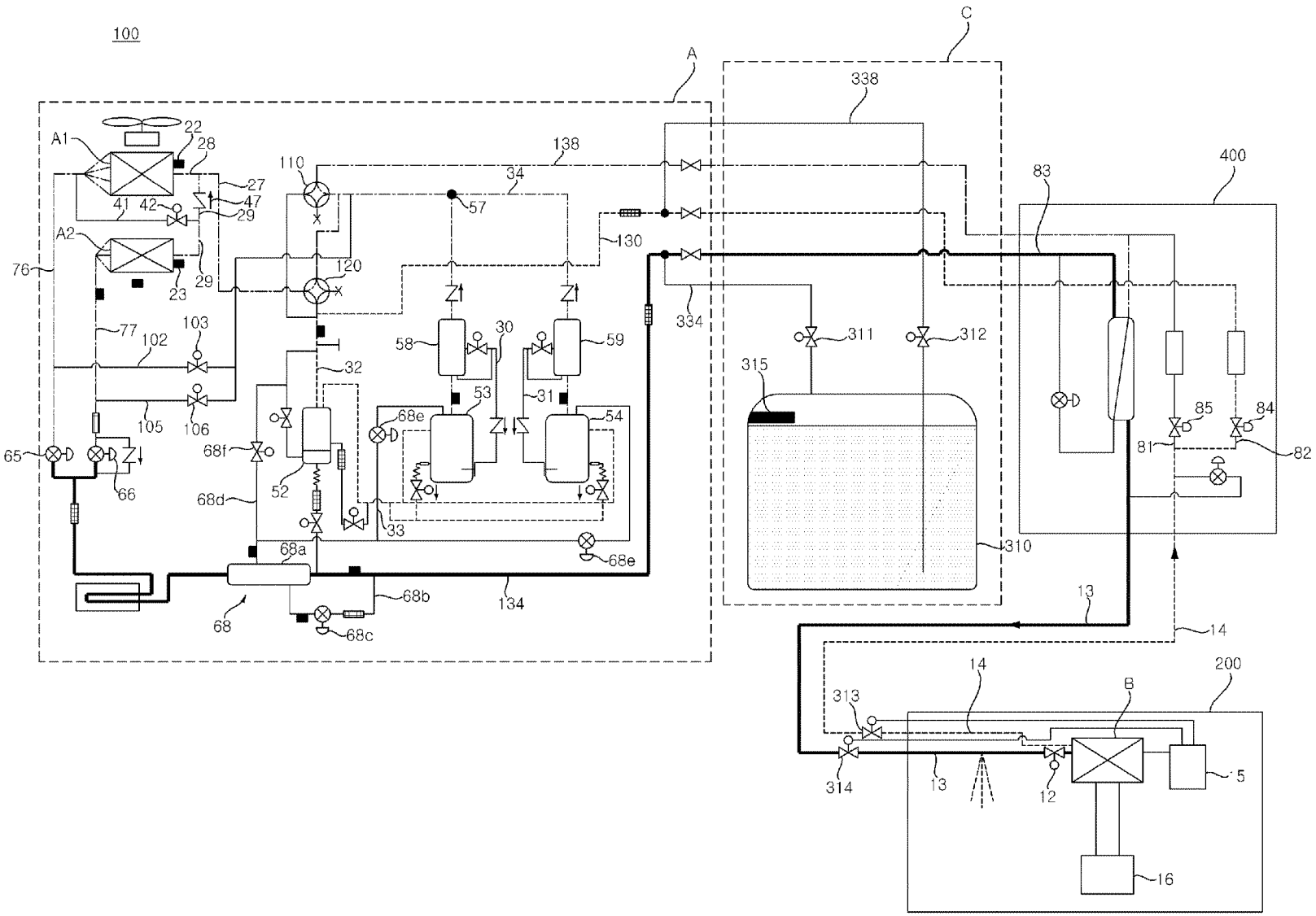
FIG. 12 is an operation diagram illustrating a refrigerant leakage detection when a multi-air conditioner for heating/cooling operation is stopped according to another embodiment of the present disclosure.
Figure 13:
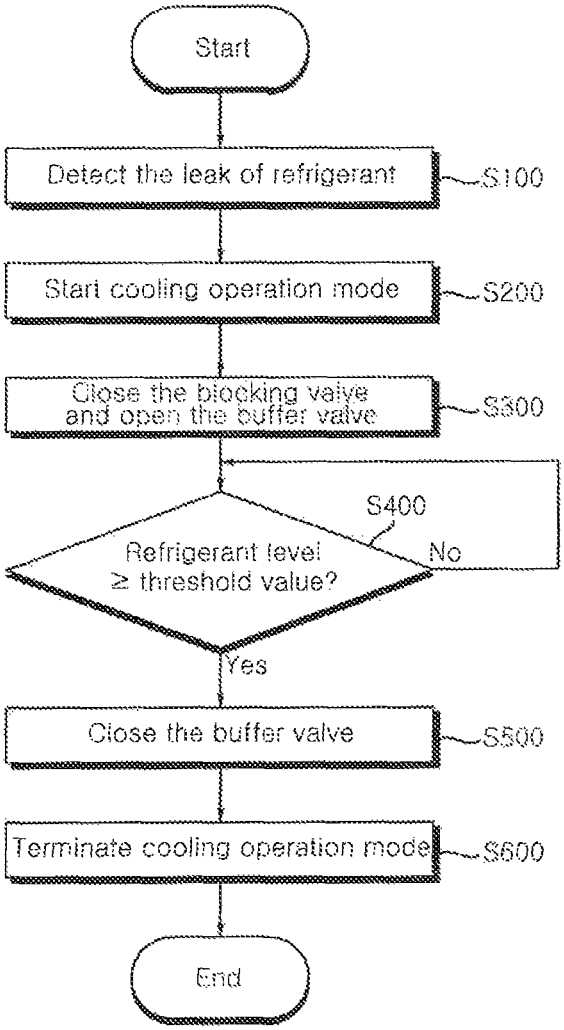
FIG. 13 is a flowchart of refrigerant leakage detection when the multi-air conditioner for heating/cooling operation of FIG. 12 is stopped.
Figure 14:
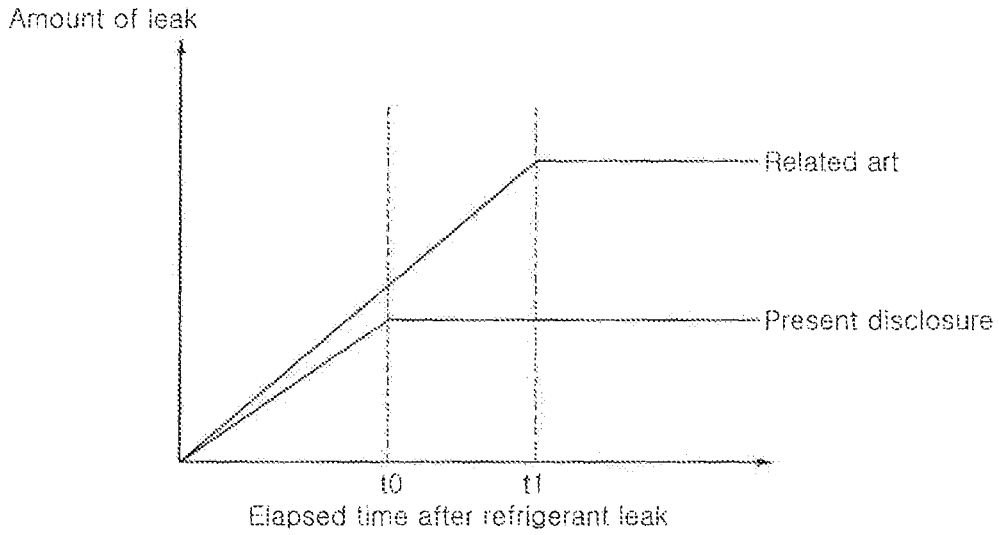
FIG. 14 is a graph illustrating a refrigerant leakage reduction effect according to a refrigerant detection method of the present disclosure.

FIG. 12 is an operation diagram illustrating a refrigerant leakage detection when a multi-air conditioner for heating/cooling operation is stopped according to another embodiment of the present disclosure, FIG. 13 is a flowchart of refrigerant leakage detection when the multi-air conditioner for heating/cooling operation of FIG. 12 is stopped, and FIG. 14 is a graph illustrating a refrigerant leakage reduction effect according to a refrigerant detection method of the present disclosure.

The leak detection when the multi-air conditioner for heating/cooling operation of FIG. 12 is stopped is described based on the simultaneous-type possible embodiment of FIG. 8, but is not limited thereto.

When the refrigerant leaks from the liquid pipe during stop, the refrigerant leakage detection operation is performed as shown in FIG. 13.

When a leak occurs in the liquid pipe 134, 13, first, the leak is detected by the leak sensor 16 installed in the room 200, which is transmitted as a detection signal to the controller 15 of the indoor unit B (S10).

When the controller 15 of the indoor unit B transmits a corresponding detection signal to the controller of the outdoor unit A through outdoor unit-indoor unit communication, the controller 15 of the outdoor unit A starts a refrigerant leak detection operation.

Since the pressures of all pipes are the same when the leak detection signal is received, the controller executes the whole system in the cooling operation mode in order to induce a pressure difference for collecting the refrigerant in the buffer tank 310 (S200).

That is, the high-temperature and high-pressure refrigerant compressed in the compressor 53, 54 flows through the outdoor heat exchanger A1, A2 and is further condensed.

The first four-way valve 110 is set to an off mode in which the refrigerant discharged from the compressor 53, 54 passes through the first four-way valve 110. The second four-way valve 120 is set to an off mode in which the refrigerant discharged from the compressor 53, 54 passes through the second four-way valve. In the cooling mode, the liquid line valve, the gas pipe valve, and the common pipe valve are also opened.

In describing the flow of the refrigerant, the refrigerant discharged from the compressor 53, 54 flows to the outdoor heat exchanger A1, A2 through the second four-way valve 120. The refrigerant condensed in the outdoor heat exchanger A1, A2 flows through the liquid pipe connection pipe 134 and passes through the buffer unit C. The refrigerant flows into the indoor liquid pipe 13 of the room 200 through the liquid pipe connection pipe 134 to flow to the indoor unit B and is evaporated, and flows to the indoor gas pipe 14 and is collected in the low-pressure gas header 82 by the opening of the low pressure valve 84 of the distributor 400 and flows to the common pipe 130. The refrigerant flowing to the common pipe 130 flows into the compressor 53, 54 through the accumulator 52.

Next, all of the low pressure control valves 84 of the distributor 400 are opened so that the low pressure can be reliably obtained in the common pipe 130, and the high pressure control valve 85 is closed.

In addition, the refrigerant blocking valve 313, 314 is closed to block the flow of the refrigerant flowing in each pipe conduit (S300).

At this time, the liquid pipe blocking valve 314 and the gas pipe blocking valve 313 are simultaneously blocked, and the closing time of the liquid pipe blocking valve 314 and the gas pipe blocking valve 313 takes about 90 to 120 seconds.

In order to prevent the refrigerant flowing through the liquid pipe connection pipe 134 from continuously leaking into the room 200 during a relatively long closing period as described above, the controller opens the buffer valve 311, 312.

When the buffer valves 311 and 312 of the buffer unit C are simultaneously opened, a low pressure is set in the bottom side of the buffer tank 310, and a high pressure is set in the inlet side from the liquid pipe buffer pipe 334 connected to the liquid connection pipe 134, so that the refrigerant in the high-pressure side is collected in the buffer tank 310.

Since the buffer valve 311, 312 is a solenoid valve that operates instantaneously, the buffer valve 311, 312 is opened rapidly to collect refrigerant in the buffer tank 310.

Accordingly, when the compressor 53, 54 is stopped, the refrigerant remaining in the high-pressure liquid pipe 314, 13 does not flow into the room, but is bypassed to the buffer tank 310 and collected, thereby blocking the refrigerant from leaking into the room 200.

At this time, the water level sensor 315 in the buffer tank 310 periodically detects the water level, and when the refrigerant level reaches a certain threshold value or higher, a corresponding detection signal is transmitted to the controller (S400).

In this case, the threshold value is the maximum value of the refrigerant that the buffer tank 310 can collect, and may indicate a refrigerant volume when all the refrigerants are collected in the liquid pipe 314, 13.

That is, when it is the threshold value or more, it can be determined that there is no refrigerant remaining in the pipe.

When receiving a corresponding detection signal from the water level sensor 315, the controller closes the buffer valve 311, 312 and notifies a maintenance request by transmitting the leak of refrigerant to a user or a manager (S500).

As described above, in the case where the refrigerant leaks, when using the refrigerant blocking valve 313, 314, a position of the refrigerant blocking valve 313, 314 is set to the outside of the room 200 to minimize the amount of refrigerant remaining in the room 200.

In addition, as shown in FIG. 14, comparing the case of including only the conventional refrigerant blocking valve with the case of including the buffer unit, as time elapses after refrigerant leakage, the amount of leaking refrigerant increases until the refrigerant blocking valve 313, 314 is completely blocked (t1).

At this time, when the refrigerant is collected in the buffer tank 310 on the pipe including the buffer unit C as in the embodiment of the present disclosure, the buffer valve 311, 312 is opened before the blocking valve 313, 314 is completely blocked so as to collect refrigerant to be leaked.

Accordingly, since the refrigerant is not leaked and the refrigerant is already collected in the tank 310 so that the refrigerant in the liquid pipe connection pipe 314, 13 does not remain due to the opening of the buffer valve 311, 312, the time t0 during which the leakage amount is saturated is remarkably shortened, and the leakage amount itself is also significantly reduced.

As described above, the present disclosure can minimize the amount of leaking refrigerant by collecting the refrigerant in the buffer tank, when the refrigerant leaks.

In addition, when the refrigerant flow is blocked by applying the blocking valve in the leak of refrigerant, it is possible to have a minimal effect on the user by setting the optimized position of the blocking valve.

In addition, the pressure of the liquid pipe may be lowered to minimize the amount of leaking refrigerant during the time when the blocking valve is closed, thereby reducing the total amount of leaking refrigerant.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A multi-air conditioner for heating/cooling operation, the multi-air conditioner comprising:

at least one indoor unit which is installed in a room, and comprises an indoor heat exchanger;

an outdoor unit which is connected to the indoor unit through a refrigerant pipe, and comprises an outdoor heat exchanger, a compressor, an outdoor expansion valve, and a four-way valve;

at least one leakage blocking valve which is formed on the refrigerant pipe, and blocks a refrigerant flow in the refrigerant pipe when a refrigerant leak occurs from the refrigerant pipe in the room; and a buffer unit which is installed on the refrigerant pipe between the indoor unit and the outdoor unit, and is configured to collect refrigerant leaking from the refrigerant pipe, wherein the buffer unit comprises:

a buffer tank configured to collect the refrigerant flowing in the refrigerant pipe;

a low-pressure buffer pipe disposed outside of the buffer tank and extends through a top of the buffer tank to a bottom portion of the buffer tank and is configured to set a low pressure in the buffer tank by allowing a flow of the low-pressure buffer pipe; and a high-pressure buffer pipe disposed outside of the buffer tank and extends through the top of the buffer tank to an upper portion of the buffer tank and is configured to set a high pressure in the buffer tank by allowing a flow of the high-pressure buffer pipe, wherein the refrigerant pipe comprises:

a liquid pipe connection pipe through which a high-pressure liquid refrigerant is to flow;

a gas pipe connection pipe through which a high-pressure gas refrigerant is to flow; and a common pipe through which a low-pressure gas refrigerant of low pressure is to flow from the outdoor unit, wherein the common pipe is connected to the low-pressure buffer pipe to set a low pressure in the buffer tank by allowing the flow of the low-pressure buffer pipe, wherein the buffer unit includes a first buffer valve to open and close the flow of the high-pressure buffer pipe, and a second buffer valve to open and close the flow of the low-pressure buffer pipe, and the first and second buffer valves are configured to be opened while the at least one leakage blocking valve is in the process of closing such that the low pressure is set in the bottom of the buffer tank by the low-pressure buffer pipe, the high pressure is set in the upper portion of the buffer tank by the high-pressure buffer pipe, and pressure difference between the low pressure and the high pressure is to collect the high-pressure liquid refrigerant in the buffer tank prior to closing of the at least one leakage blocking valve.

2. The multi-air conditioner of claim 1, wherein the at least one leakage blocking valve is installed outside the room in which the indoor unit is installed.

3. The multi-air conditioner of claim 2, wherein the high-pressure buffer pipe is connected to the liquid pipe connection pipe to allow a flow of the refrigerant of the liquid pipe connection pipe.

4. The multi-air conditioner of claim 3, wherein the first and second buffer valves are opened to flow the refrigerant when the refrigerant leaks and prior to the closing of the at least one leakage blocking valve.

5. The multi-air conditioner of claim 4, wherein a closing time of the leakage blocking valve is longer than an opening time of the first and second buffer valves.

6. The multi-air conditioner of claim 5, wherein when a refrigerant leak is detected in the room, the leakage blocking valve is in the process of being closed and, at the same time, the first and second buffer valves are opened so that the refrigerant flowing in the refrigerant pipe is collected in the buffer tank prior to the closing of the leakage blocking valve.

7. The multi-air conditioner of claim 6, further comprising a water level sensor on an inner wall of the buffer tank.

8. The multi-air conditioner of claim 7, wherein the water level sensor periodically detects a level of the collected refrigerant, and the first and second buffer valves are closed when a detected value is greater than or equal to a threshold value.

9. The multi-air conditioner of claim 8, further comprising:

a leak detection sensor which detects a refrigerant leak from the refrigerant pipe in the room; and an indoor unit controller which transmits a leak detection signal to the outdoor unit when the leak detection signal is received from the leak detection sensor.

10. The multi-air conditioner of claim 9, wherein the outdoor unit further comprises a controller which controls the compressor, the four-way valve, the leakage blocking valve, and the first and second buffer valves when the leak detection signal is received from the indoor unit controller.

11. The multi-air conditioner of claim 10, further comprising a distributor which is disposed between the outdoor unit and the at least one indoor unit, and the distributor is configured to distribute the refrigerant to the at least one indoor unit according to a cooling or heating operation mode.

12. The multi-air conditioner of claim 11, wherein the distributor comprises:

a low-pressure valve which flows the low-pressure gas refrigerant to a gas pipe connected to the indoor unit; and a high-pressure valve which flows the high-pressure gas refrigerant to the gas pipe connected to the indoor unit.

13. The multi-air conditioner of claim 12, wherein the distributor further comprises:

a liquid header;

a low-pressure gas header; and a high-pressure gas header through which the refrigerant having a higher pressure than the refrigerant in the low-pressure gas header flows.

14. The multi-air conditioner of claim 13, wherein when the refrigerant leak is detected, the low-pressure valve is completely opened.

* * * * *